US007578029B2

(12) United States Patent
Prieur

(10) Patent No.: US 7,578,029 B2
(45) Date of Patent: Aug. 25, 2009

(54) DOOR STOP WITH INDETERMINATE RETAINING POSITIONS

(76) Inventor: Andre Prieur, 47bis, rue de la Pelouse, Neuilly Plaisance (FR) 93360

( * ) Notice: Subject to any disclaimer, the term of this patent is extended or adjusted under 35 U.S.C. 154(b) by 211 days.

(21) Appl. No.: 11/573,044

(22) PCT Filed: Jul. 22, 2005

(86) PCT No.: PCT/FR2005/001901

§ 371 (c)(1),
(2), (4) Date: Feb. 1, 2007

(87) PCT Pub. No.: WO2006/024736

PCT Pub. Date: Mar. 9, 2006

(65) Prior Publication Data

US 2008/0066259 A1 Mar. 20, 2008

(30) Foreign Application Priority Data

Aug. 5, 2004 (FR) ..... 04 08669

(51) Int. Cl.
*E05D 15/06* (2006.01)

(52) U.S. Cl. ..... 16/101

(58) Field of Classification Search ..... 16/86 C, 16/86 B, 334, 82, 101; 292/275, 278, 300, 292/304, 306, DIG. 15
See application file for complete search history.

(56) References Cited

U.S. PATENT DOCUMENTS 6,065,185 A * 5/2000 Breed et al. ..... 16/86 C
6,370,732 B1 4/2002 Yezersky et al.
6,467,126 B1 10/2002 Yezersky et al.

(Continued)

FOREIGN PATENT DOCUMENTS

DE 197 58 302 7/1999

(Continued)

*Primary Examiner*—Victor Batson
*Assistant Examiner*—Matthew Sullivan
(74) *Attorney, Agent, or Firm*—Oblon, Spivak, McClelland, Maier & Neustadt, P.C.

(57) ABSTRACT

The present invention relates to a door check mechanism providing infinite stable positions with applications more specifically in the area of motor vehicles, comprising on the one hand an articulated guiding arm (1), mounted to the vehicle body or to the door, and on the other hand a mechanism (9), mounted to the other part, either the door or the vehicle body, in such a way that guiding arm (1) penetrates through mechanism (9) with a relative displacement between these two parts, the wedging function resulting from a blocking of guiding arm (1) by mechanism (9).

Figure 1:
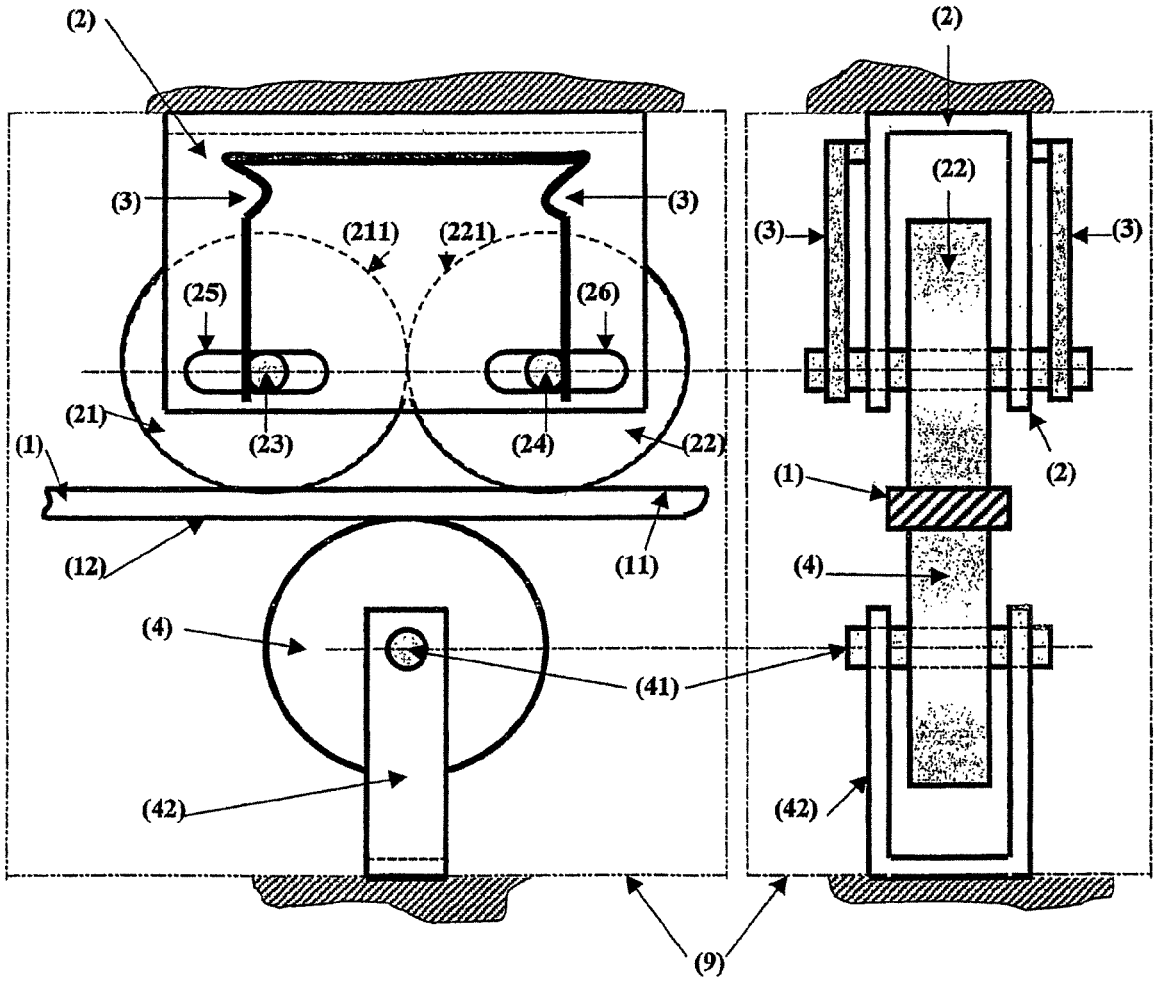

Mechanism (9) comprises a carriage device (2), including 2 braking-rollers (21) and (22), held against each other as well as against guiding arm (1), in order to ensure the wedging function. When a force, greater than a predefined load is exerted on the door, rollers (21) and (22) are such that: either one of them is pulled aside from guiding arm (1), allowing a free rotation and the release of the mechanism, or both rollers are moved aside from each other, allowing them to roll along guiding arm (1), leading to release the mechanism. The relocking is automatically done by the spring device (3), as soon as the opening or closing load disappears.

8 Claims, 21 Drawing Sheets

U.S. PATENT DOCUMENTS

| | | | | |
|---|---|---|---|---|
| 6,513,193 | B1 | 2/2003 | Yezersky et al. | |
| 6,681,444 | B2 * | 1/2004 | Breed et al. | 16/82 |
| 2004/0251696 | A1 | 12/2004 | Murayama et al. | |
| 2008/0169659 | A1 * | 7/2008 | Prieur | 292/275 |

FOREIGN PATENT DOCUMENTS

| | | |
|---|---|---|
| EP | 0 816 612 | 1/1998 |
| EP | 0 824 176 | 2/1998 |
| EP | 1 249 569 | 10/2002 |

* cited by examiner

DOOR STOP WITH INDETERMINATE RETAINING POSITIONS

The present invention relates to a mechanism allowing to hold an articulating or sliding door in an infinite number of stable positions, between fully open and closed positions, with applications more specifically in the area of motor vehicles. This mechanism, intended to be cost effective, comprises a carriage assembly mounted to the door or to the vehicle body, the said carriage includes two adjacent cylindrical rollers, which act as a wedging device in cooperation with an articulated arm, the said arm being mounted to the other part, either the vehicle body or the door. The whole mechanism allows to hold the door open in any intermediate stable position, as soon as the required opening or closing force has ceased.

Some conventional door check mechanisms are known as a result of the present art, like the door check described in patent EP 1 249 569 A1, which comprises on the one hand an articulated arm connected to one part, door or vehicle body, the said arm being formed to include notches at predefined locations; on the other hand, rollers connected to the other part and urged by a spring inside the notches to provide stable positions.

Such mechanisms have a disadvantage to allow only a limited number of predefined stable door opened positions, with a dragging effect near each of these positions, imposing to hold the door when there is a risk to interfere with an object besides the door, like a pillar, a wall, or an other vehicle. Such an operation may even become hazardous if a passenger, while getting out of the vehicle, does not hold the door due to the inconvenient position, and is hurt by a rebound of the said door.

The present invention is intended to overcome this disadvantage by providing a mechanism which allows to hold a door in an infinite number of stable positions, without excluding some preferred predefined positions.

Schematic drawings are enclosed to describe the principles according to which the mechanism proposed by the invention can be realized and how it operates.

FIG. 1: general schematic view of the mechanism proposed by the invention

Figure 2:
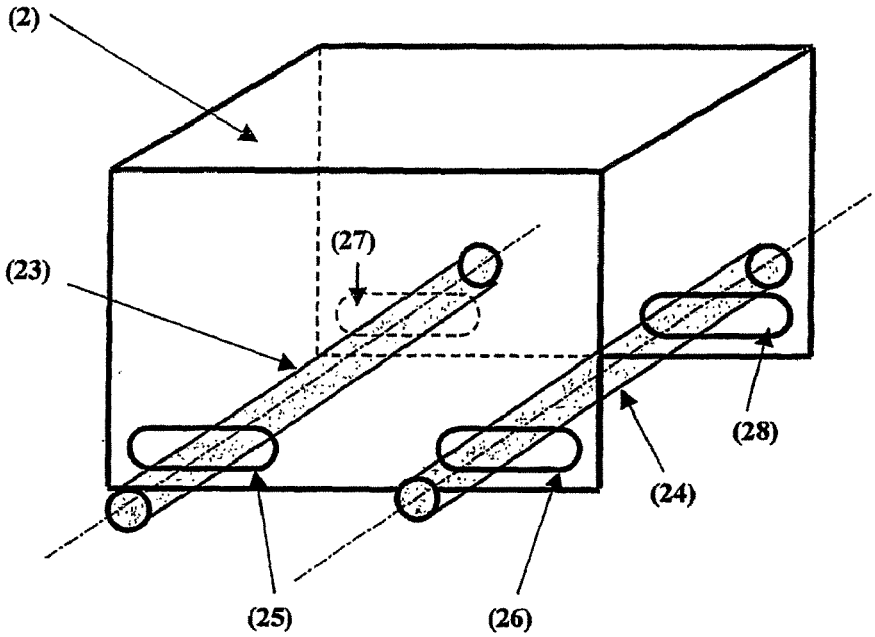

FIG. 2: body of the rollers' carriage device (2)

Figure 3:
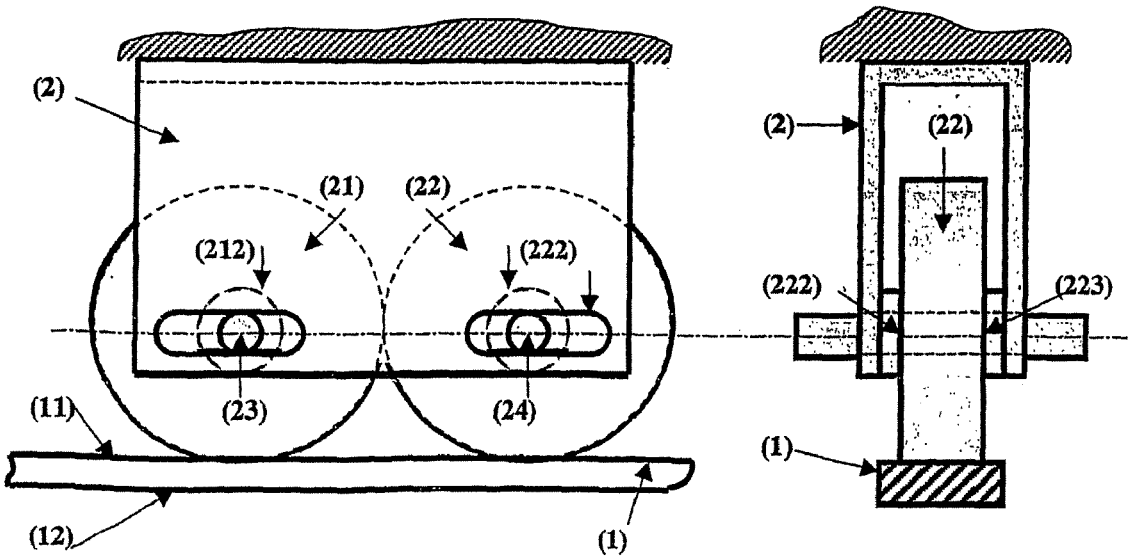

FIG. 3: optional lateral pads on rollers (21) and (22)

Figure 4:
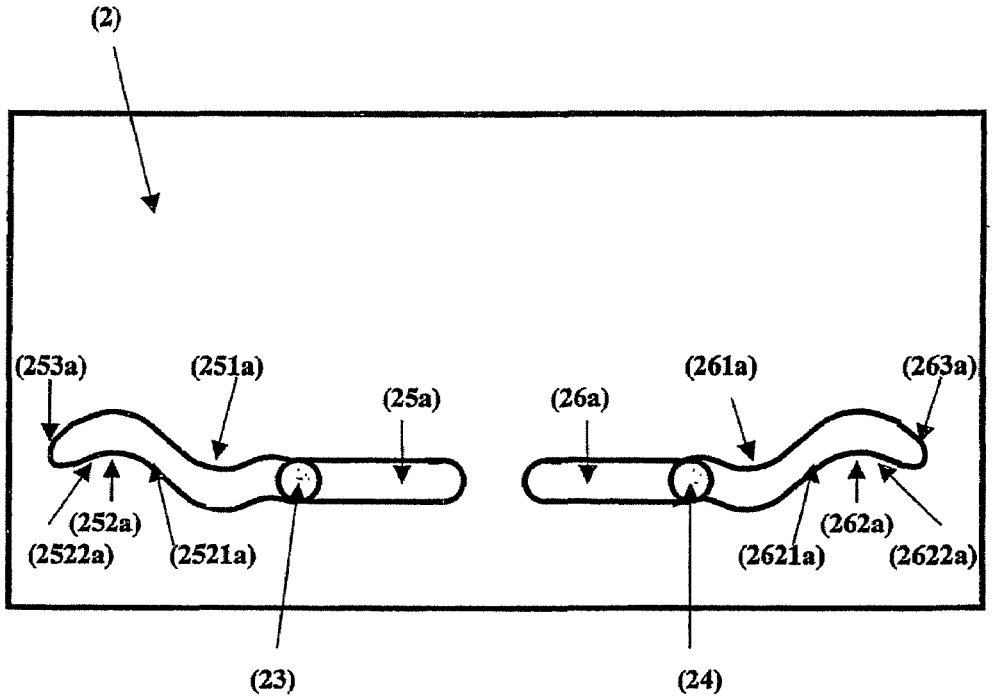
Figure 4:
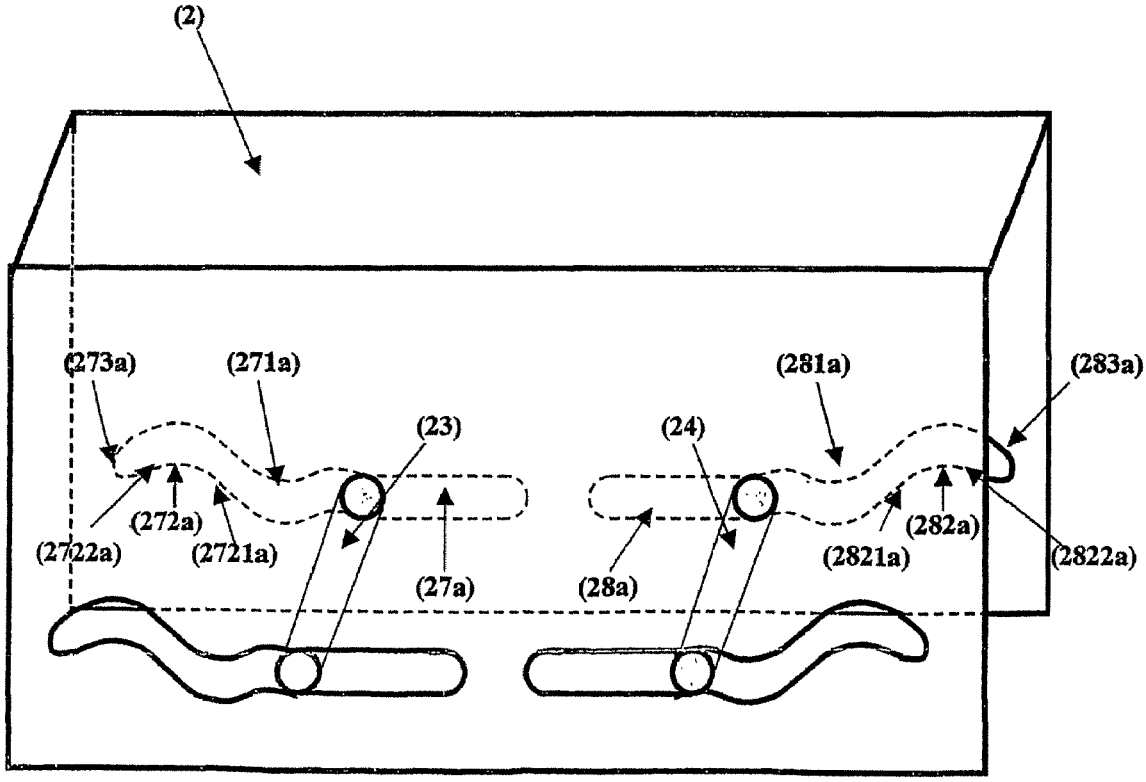
Figure 5:
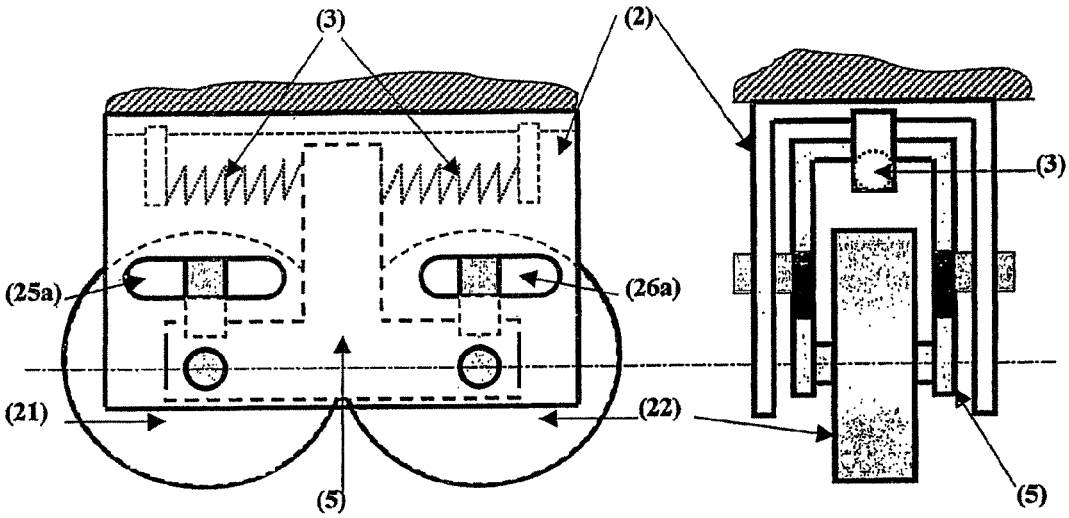

FIG. 4: schematic shapes of the lateral guiding slots, in the case where rollers (21) and (22) are held permanently in contact with each other FIG. 5: variation showing lateral guiding slots being not aligned with the axles of rollers (21) and (22)

Figure 6:
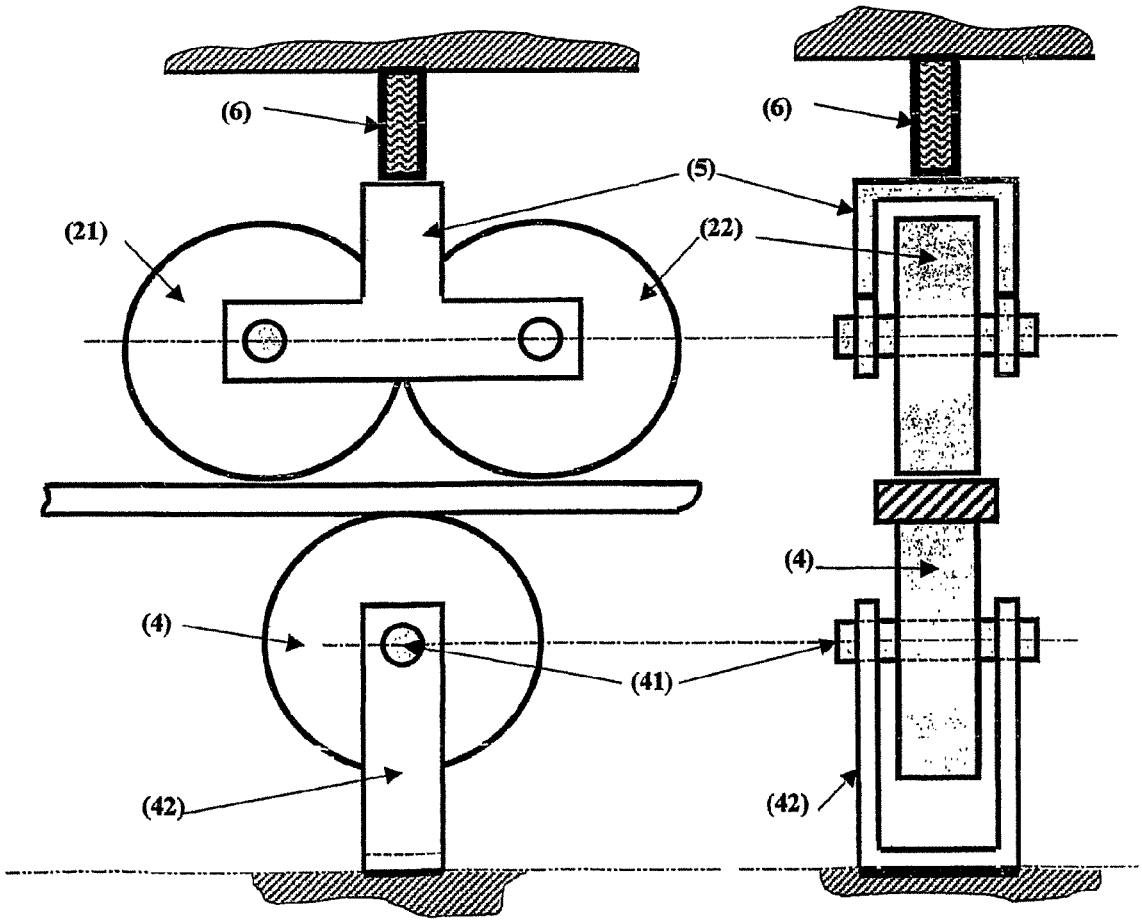
Figure 7:
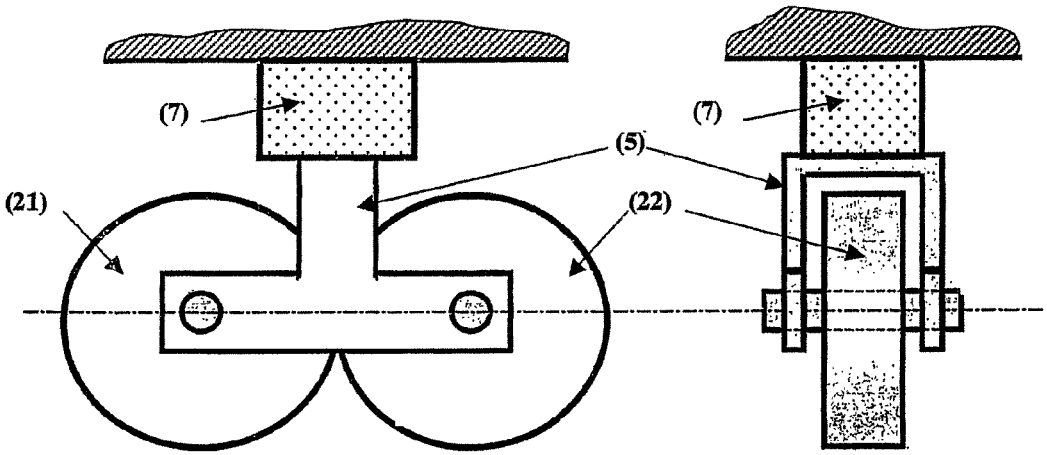
Figure 8:
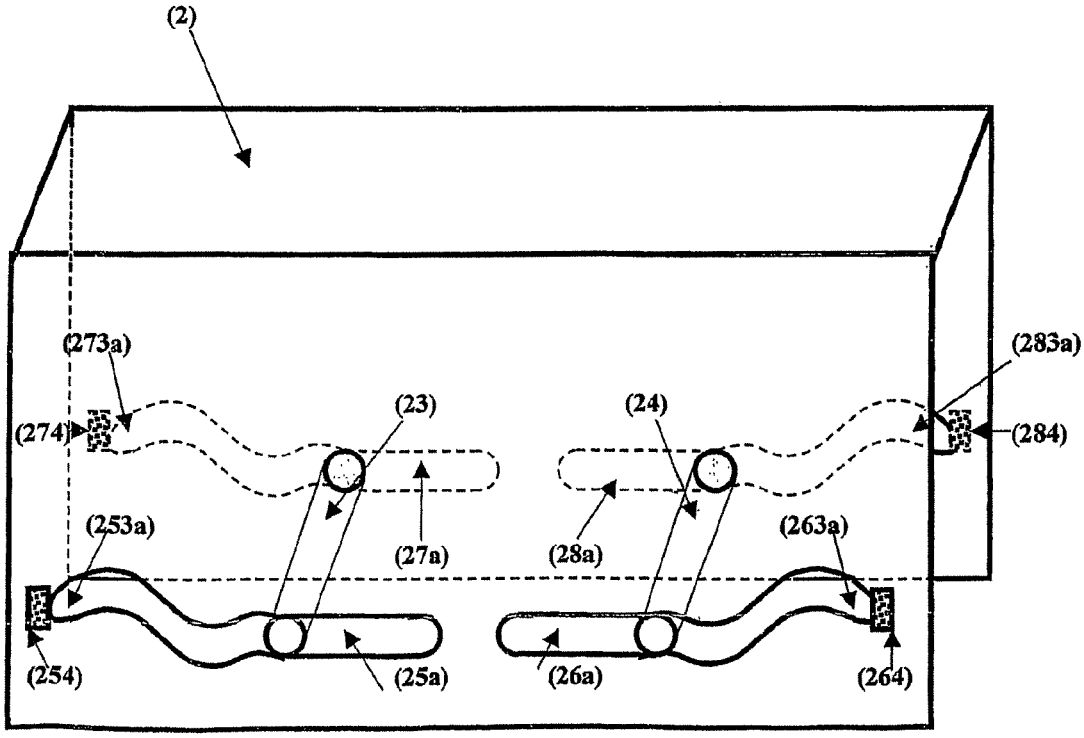
Figure 9:
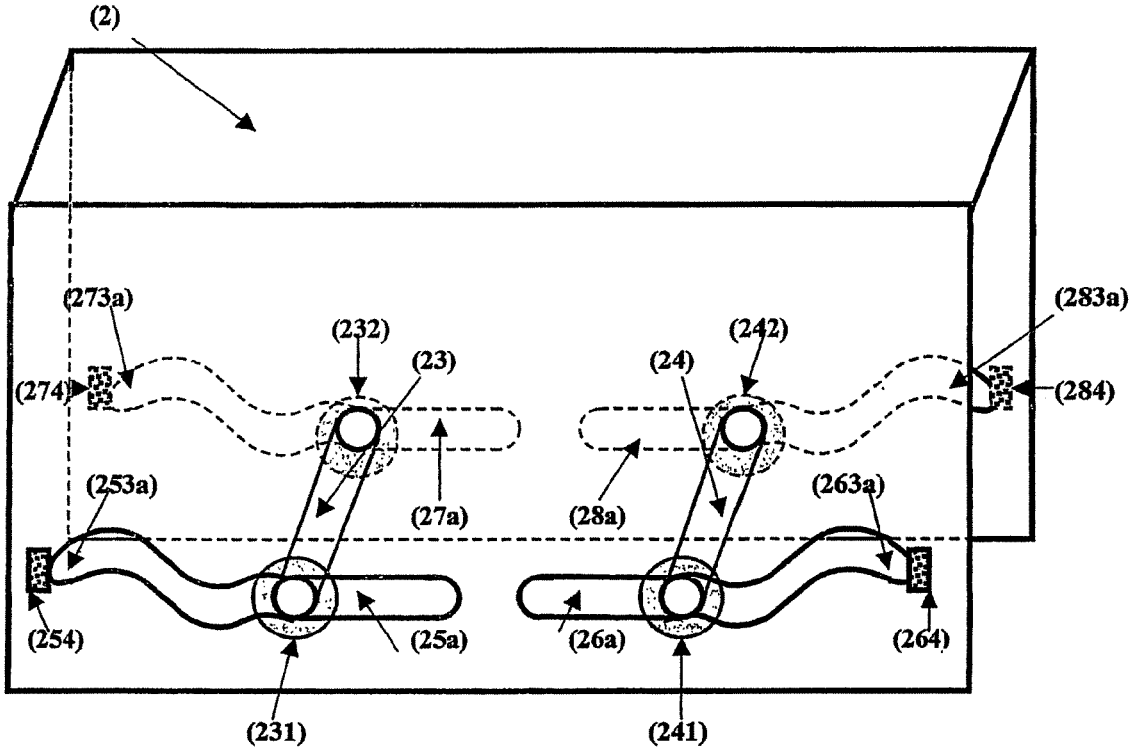

FIG. 6: variation showing an alternative where the mechanism is made of a flexible bracket directly mounted to the door or to the vehicle body FIG. 7: variation showing an alternative where the mechanism is made of an elastic block directly mounted to the door or to the vehicle body FIG. 8: schematic drawing showing magnets intended to contribute to stabilize axles (23) and (24) during opening or closing maneuvers FIG. 9: schematic drawing showing parts having magnetic properties located at the ends of axles (23) and (24)

Figure 10:
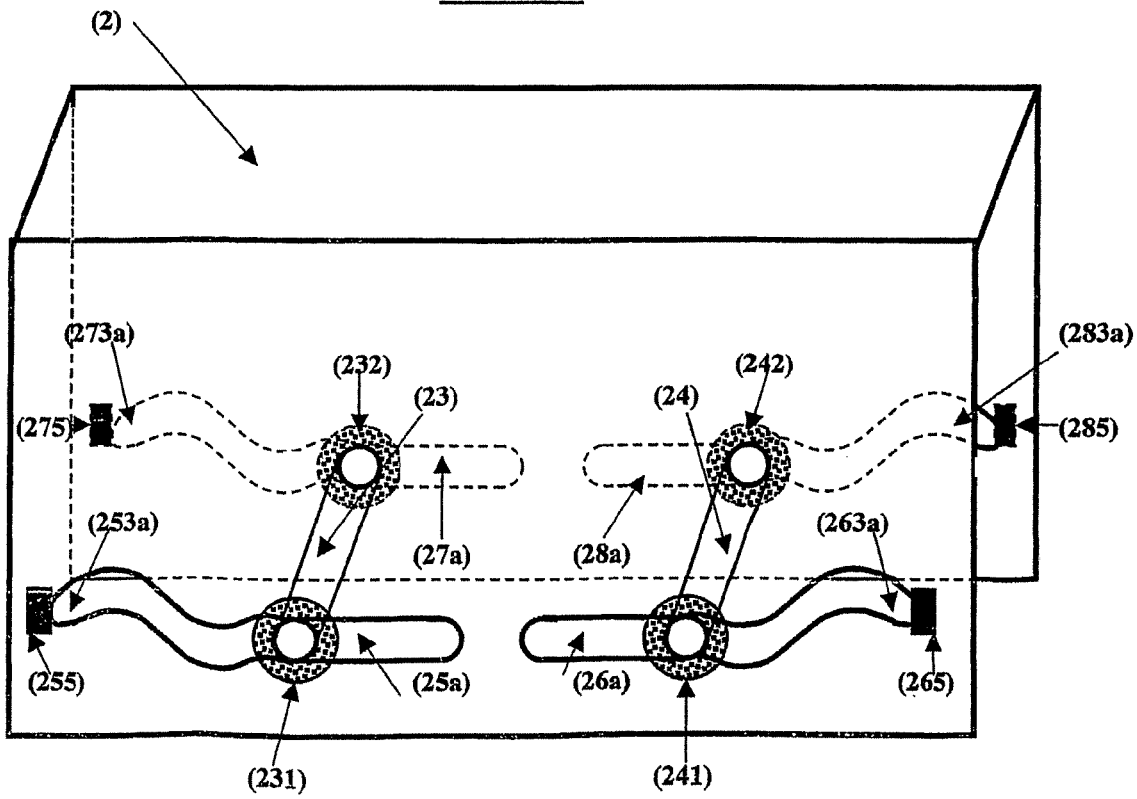

FIG. 10: schematic drawing showing magnetic parts located at the ends of axles (23) and (24)

Figure 11:
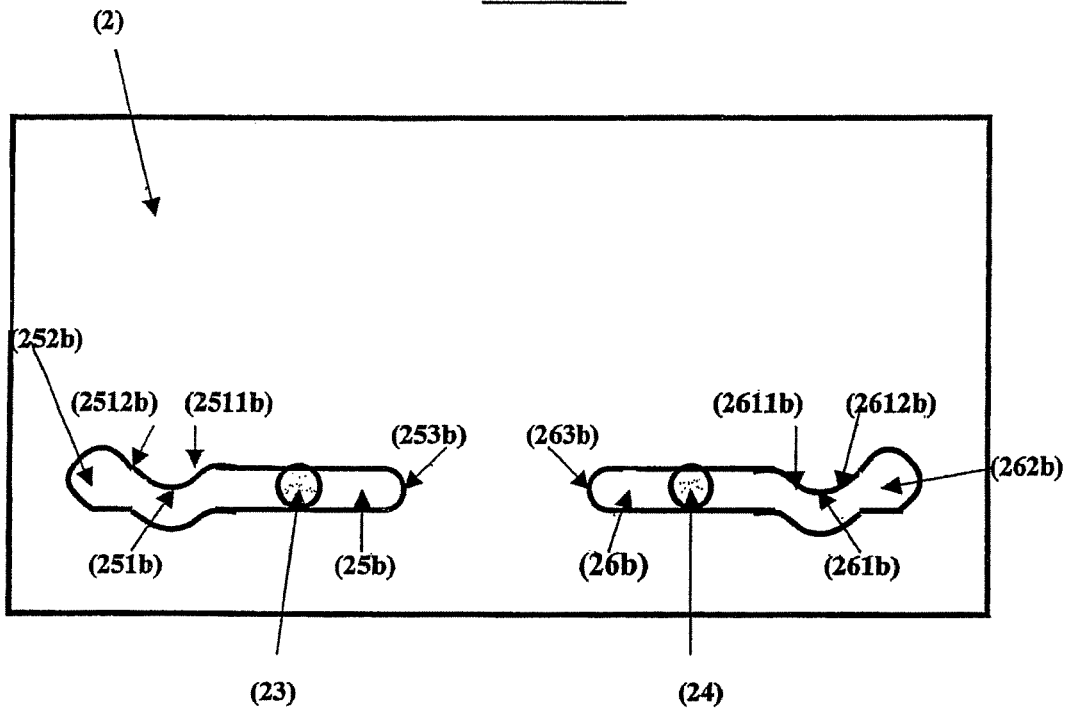
Figure 11:
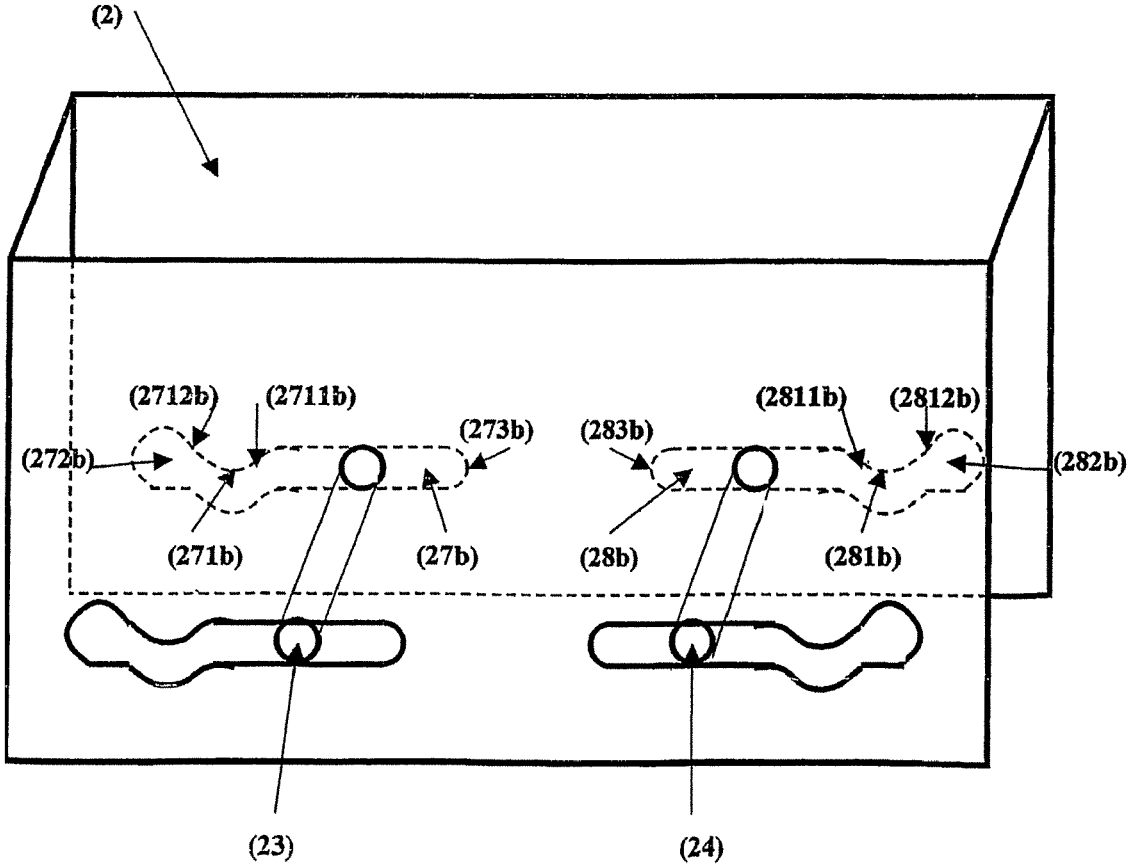
Figure 12:
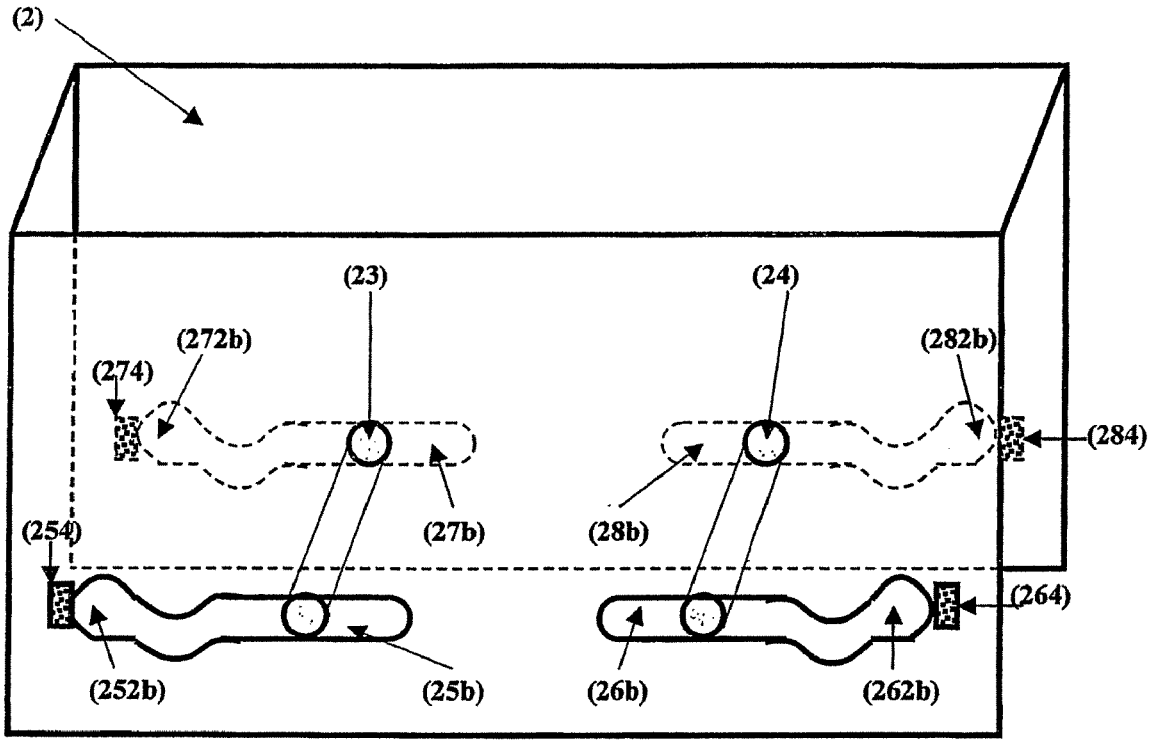

FIG. 11: schematic shapes of the lateral guiding slots, in the case where rollers (21) and (22) are not permanently held in contact with each other FIG. 12: schematic drawing showing magnets intended to contribute to stabilize axles (23) and (24) during opening or closing maneuvers, in the case illustrated on FIG. 11

Figure 13:
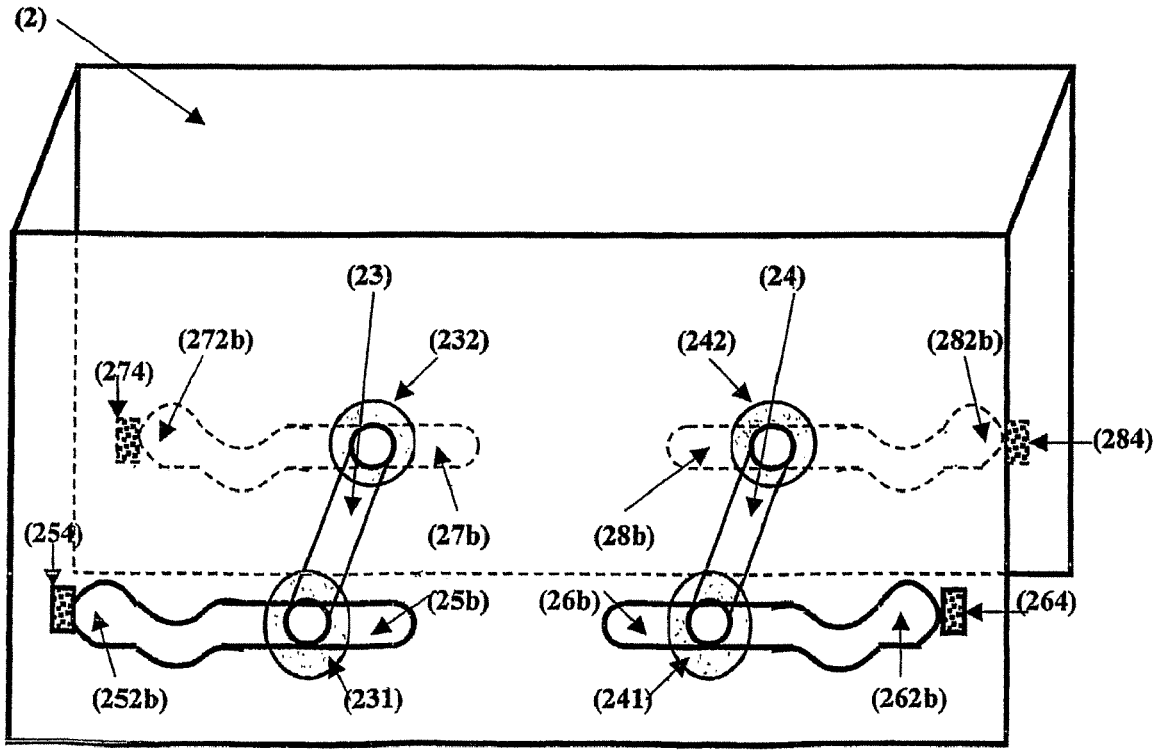

FIG. 13: schematic drawing showing parts having magnetic properties located at the ends of axles (23) and (24), in the case illustrated on FIG. 11

Figure 14:
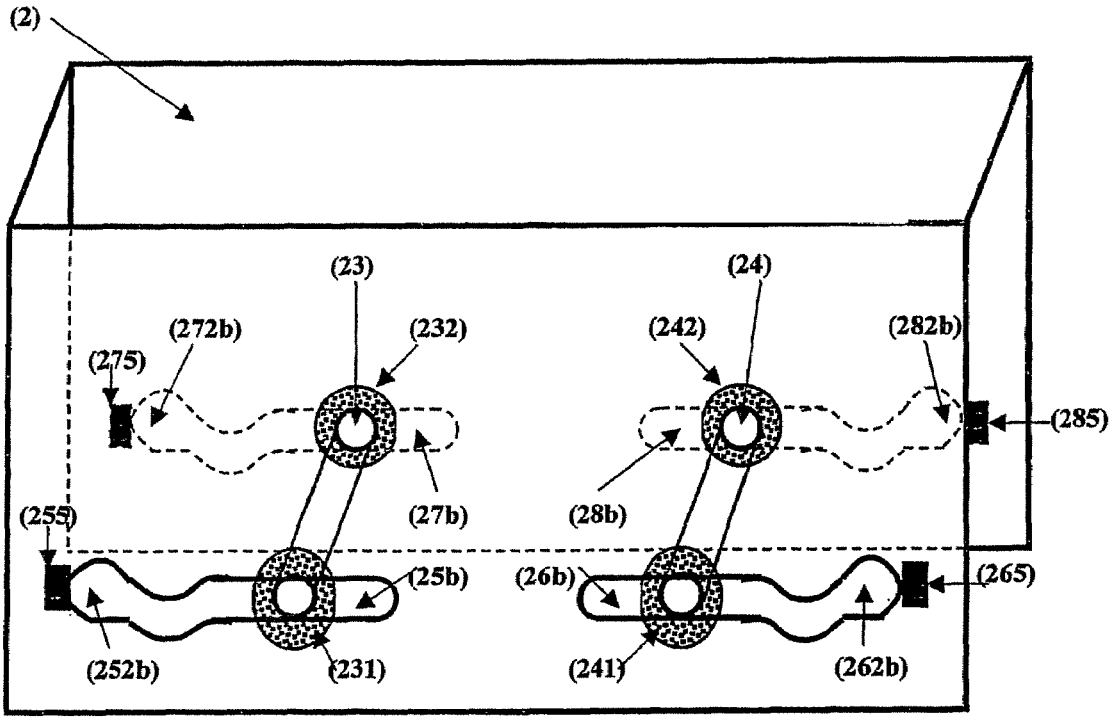

FIG. 14: schematic drawing showing magnetic parts located at the ends of axles (23) and (24), in the case illustrated on FIG. 11

Figure 15:
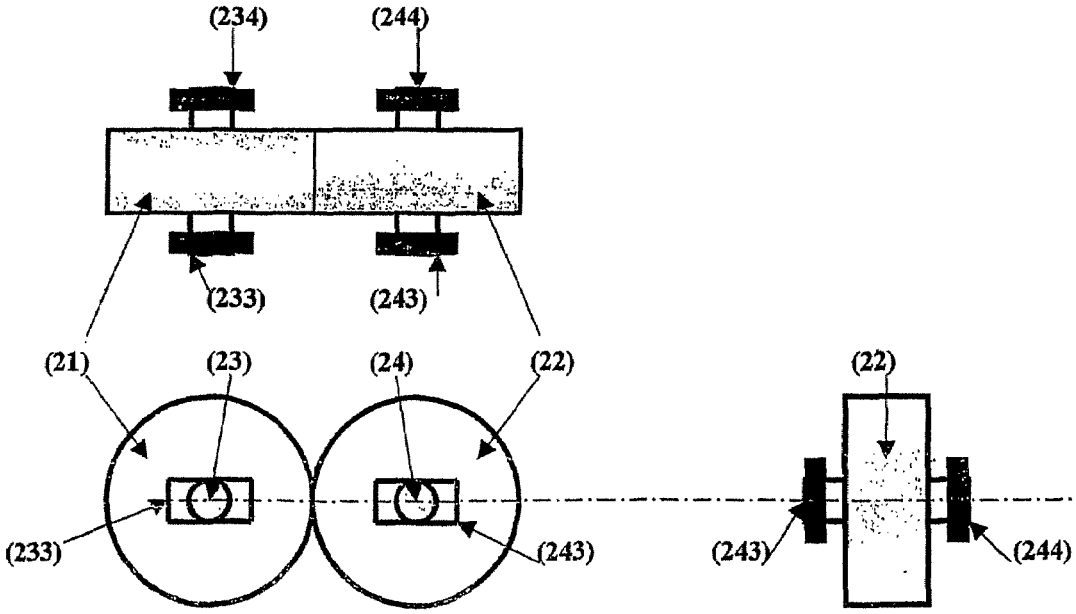

FIG. 15: schematic drawing showing sliding blocks located at the ends of axles (23) and (24)

Figure 16:
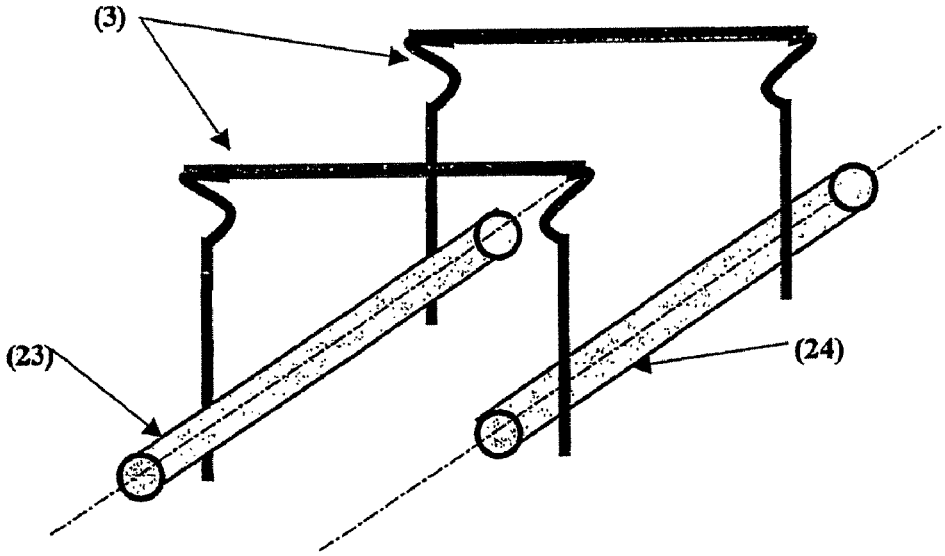

FIG. 16: schematic drawing showing spring device (3)

Figure 17:
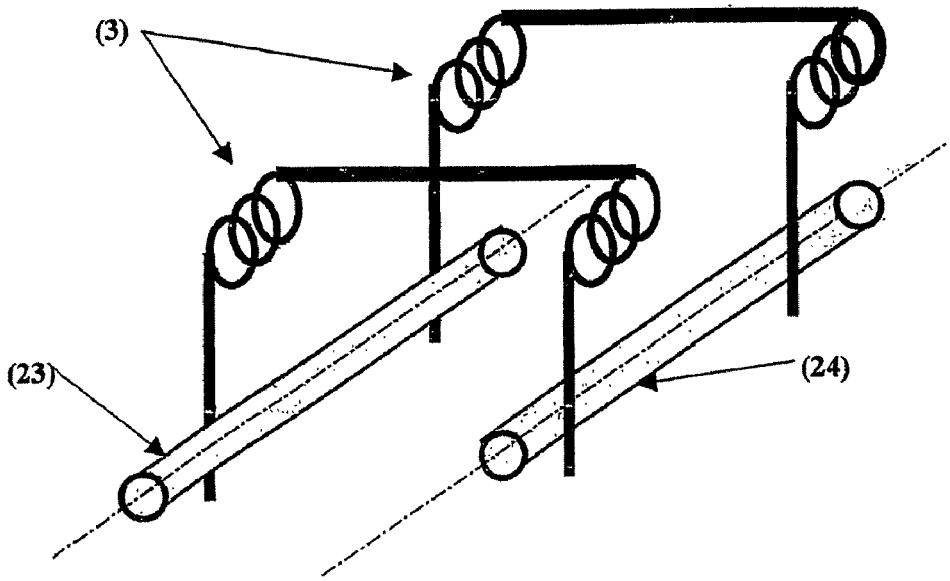

FIG. 17: variation of spring device (3)

Figure 18:
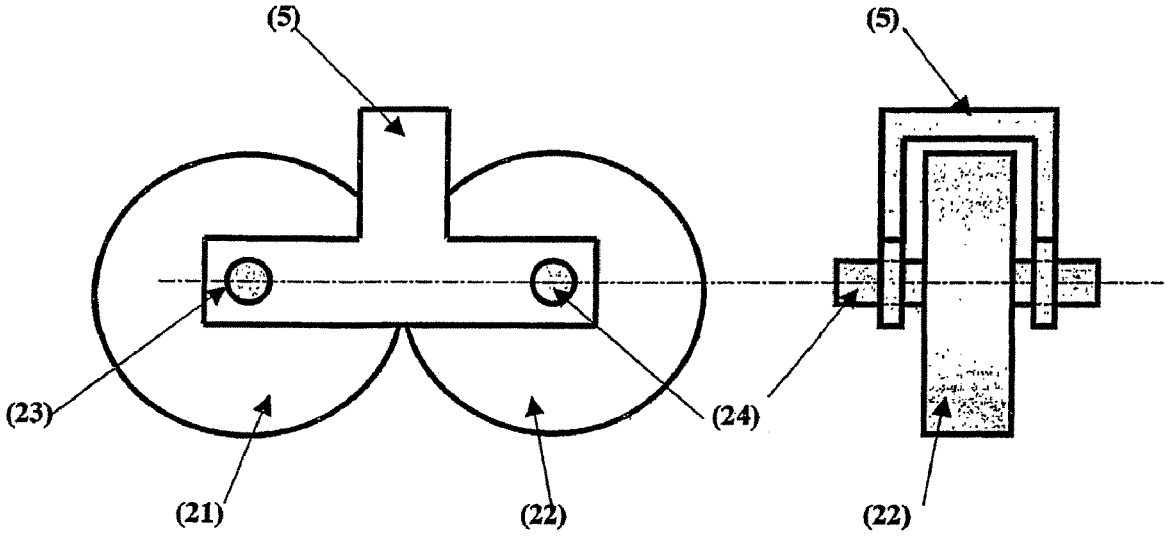
Figure 18:
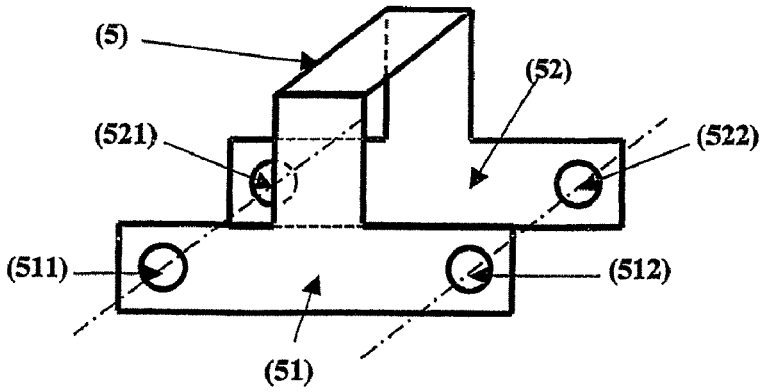

FIG. 18: example of how tie device (5) can be realized

Figure 19:
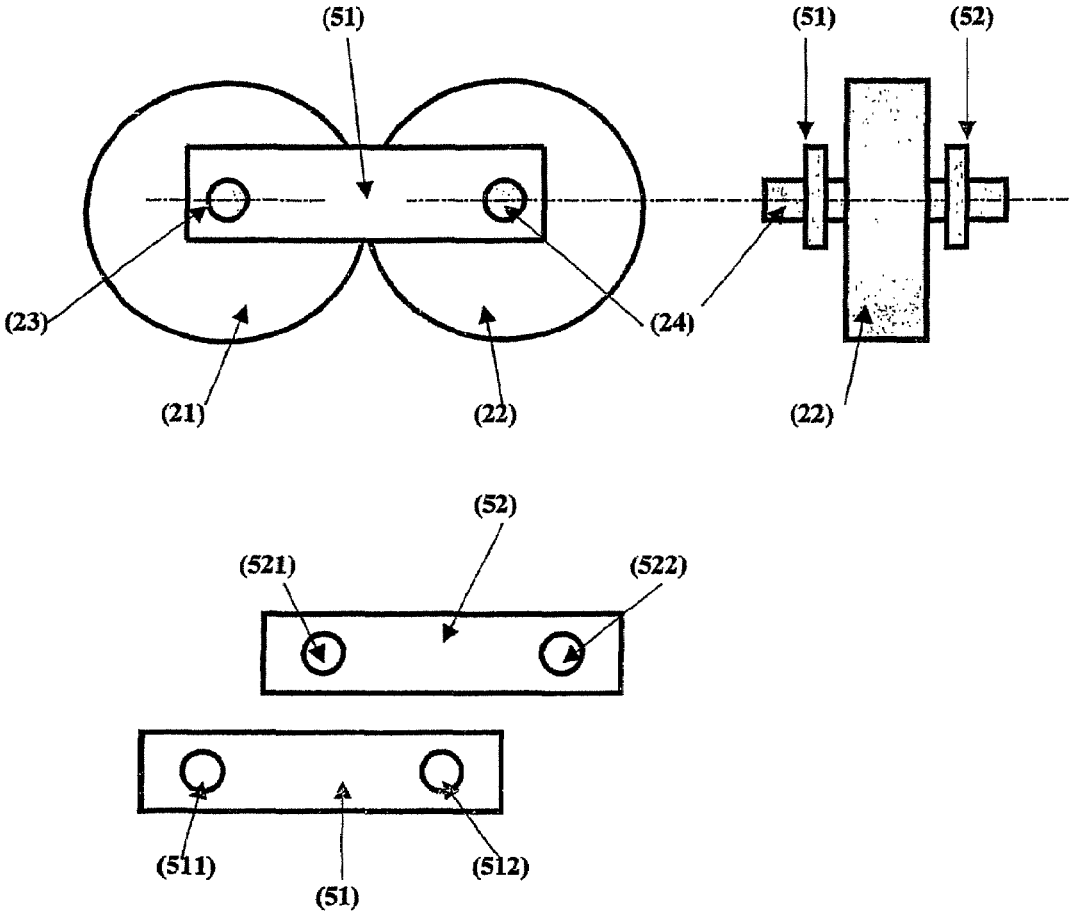

FIG. 19: variation of tie device (5)

Figure 20:
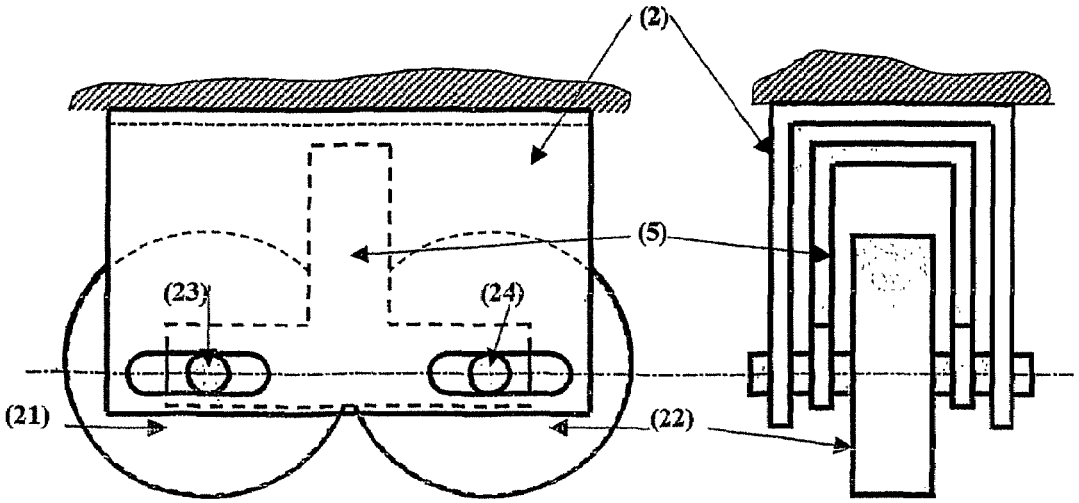

FIG. 20: schematic drawing showing an assembly between tie device (5) and the body of carriage device (2)

Figure 21:
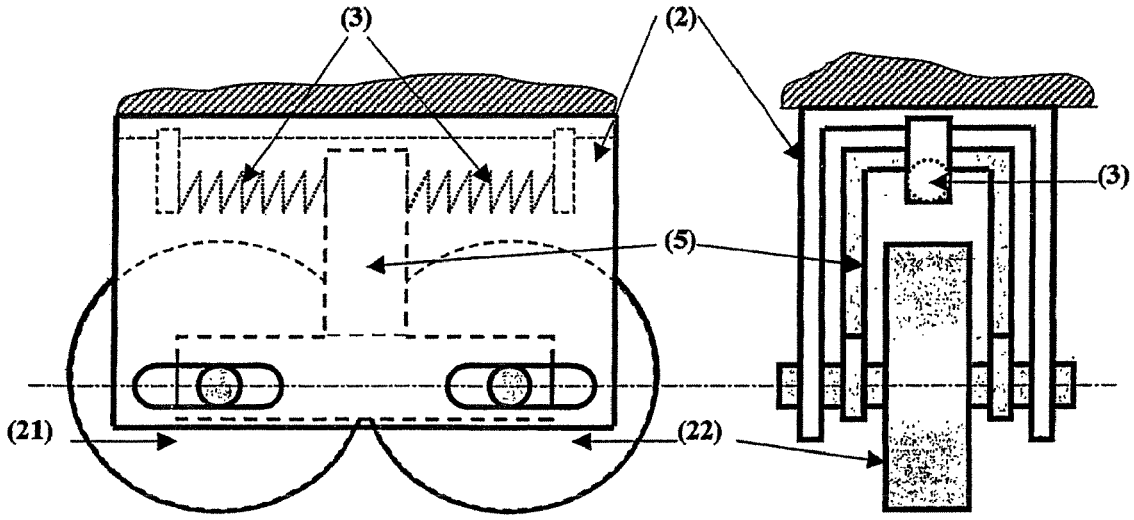

FIG. 21: illustration of spring device (3) realized with helicoidal springs mounted between carriage device (2) and tie device (5)

Figure 22:
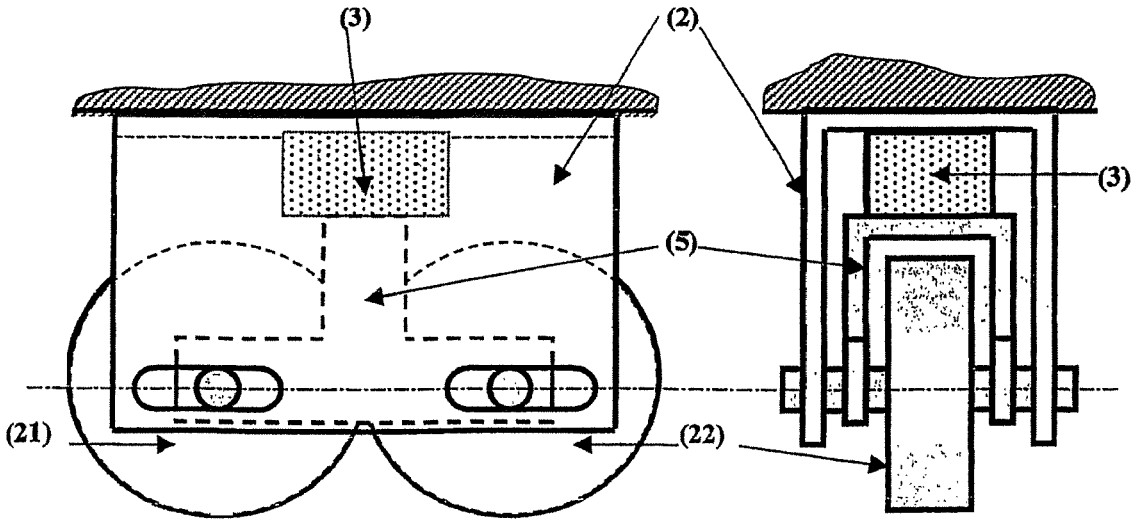

FIG. 22: variation of spring device (3) realized with a block having elastic properties, mounted between carriage device (2) and tie device (5)

Figure 23:
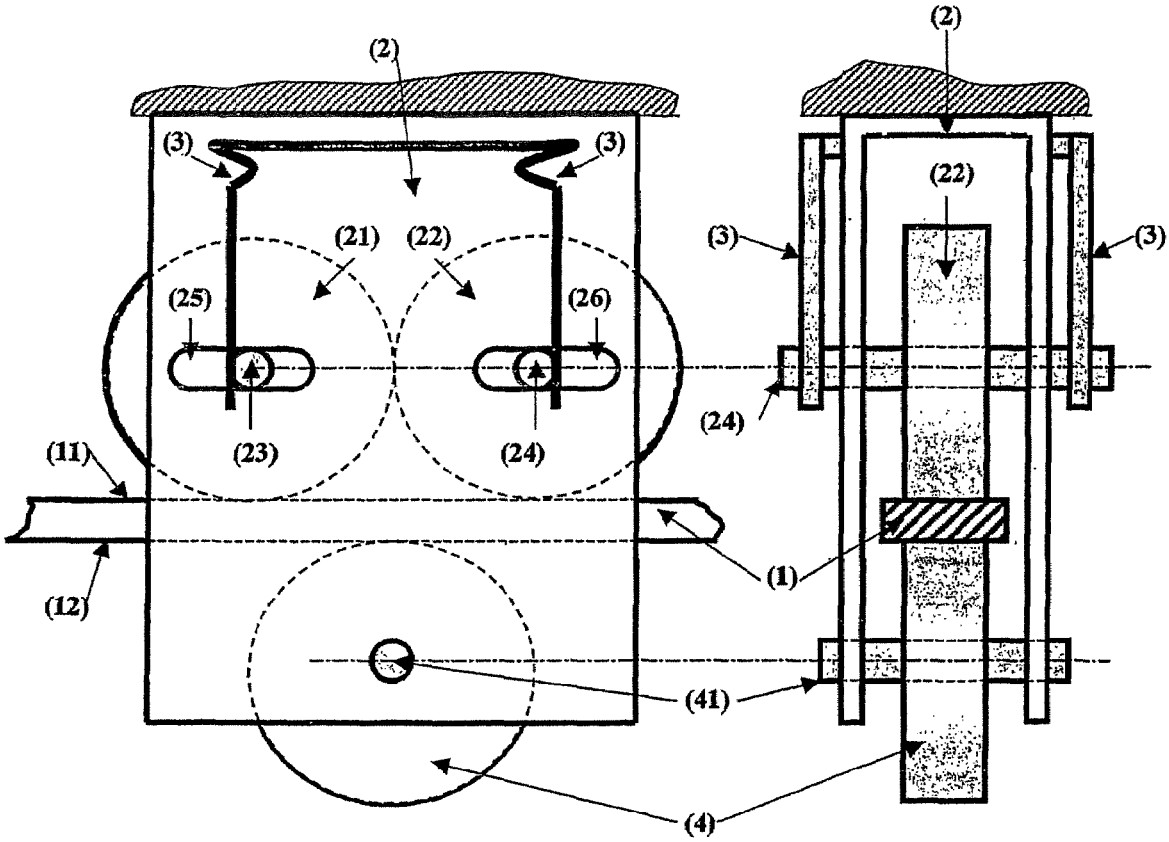

FIG. 23: variation of the mechanism where roller (4) is directly linked to carriage device (2)

Figure 24:
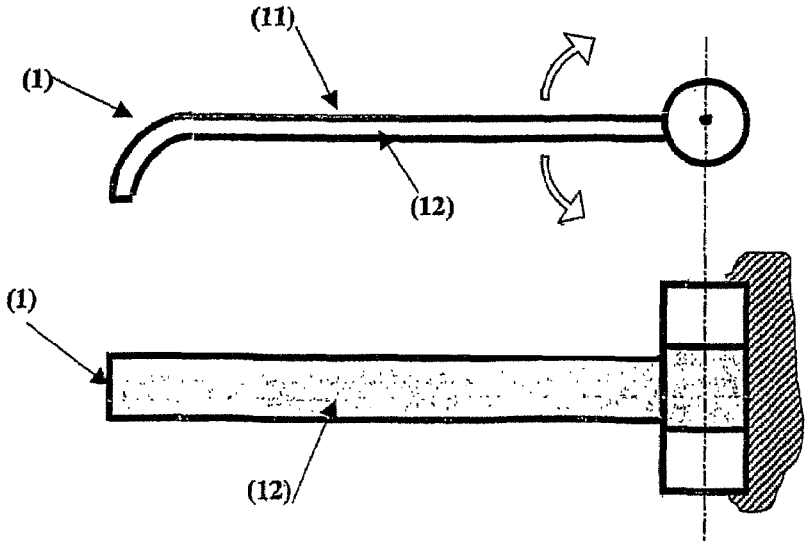

FIG. 24: schematic drawing showing guiding arm (1)

Figure 25:
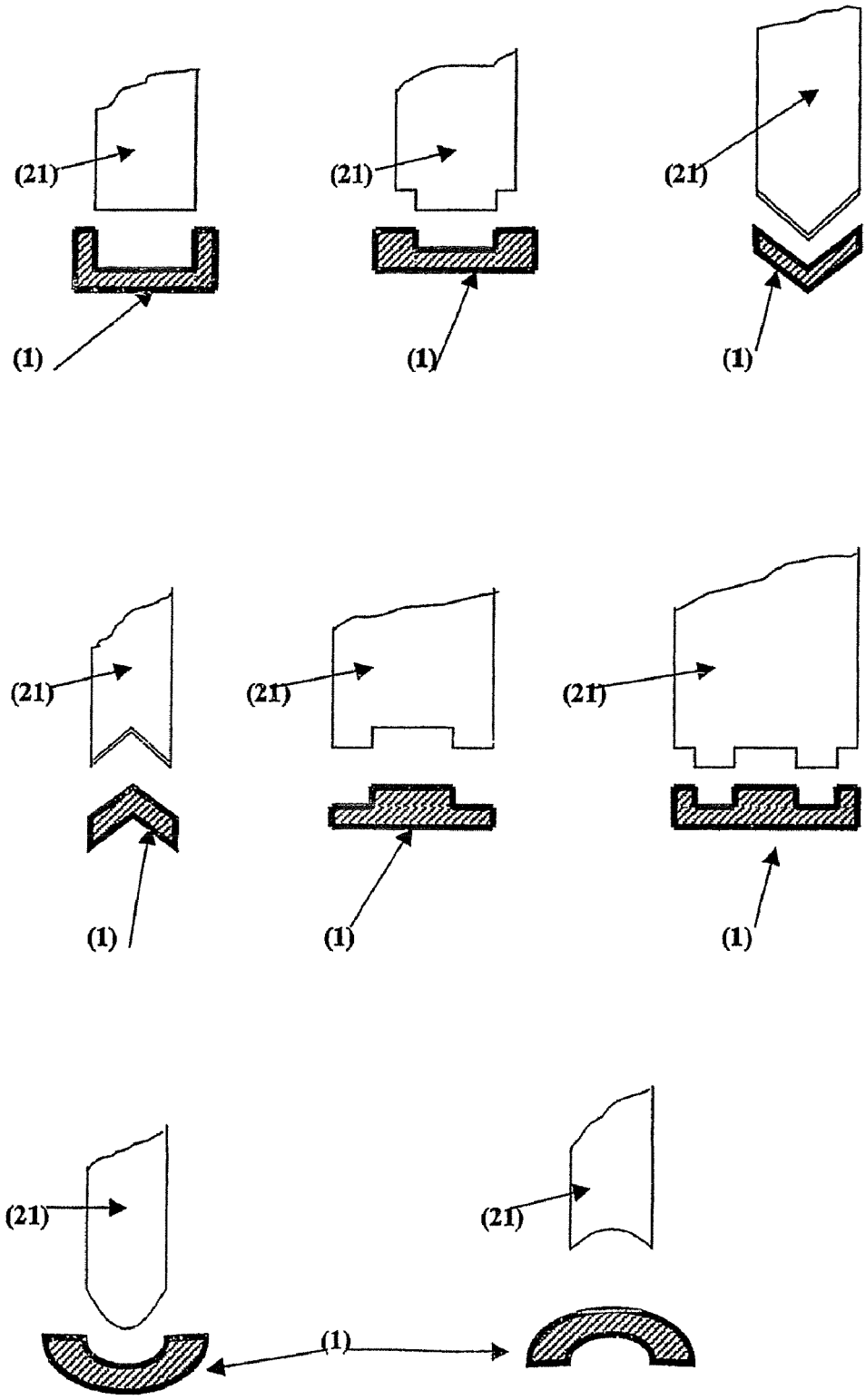

FIG. 25: examples of possible shapes for the cross section of guiding arm (1) and the corresponding profile of rollers (21) and (22)

Figure 26:
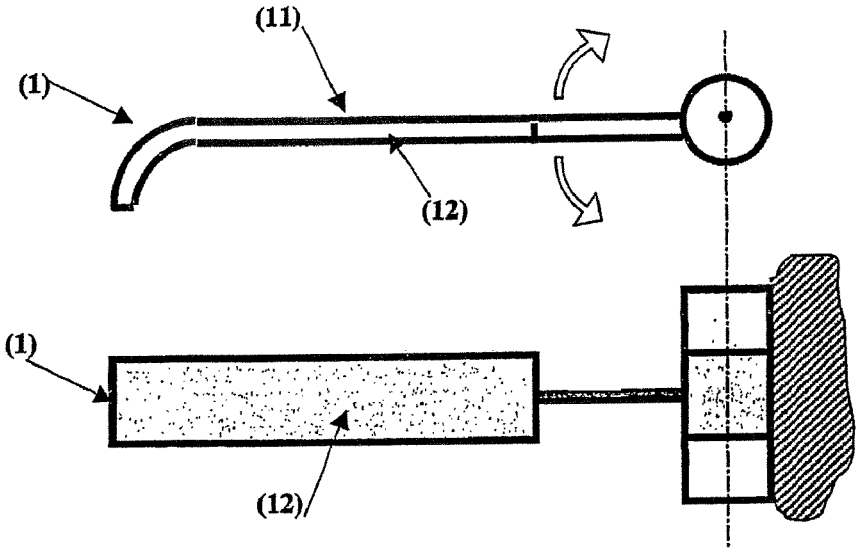
Figure 27:
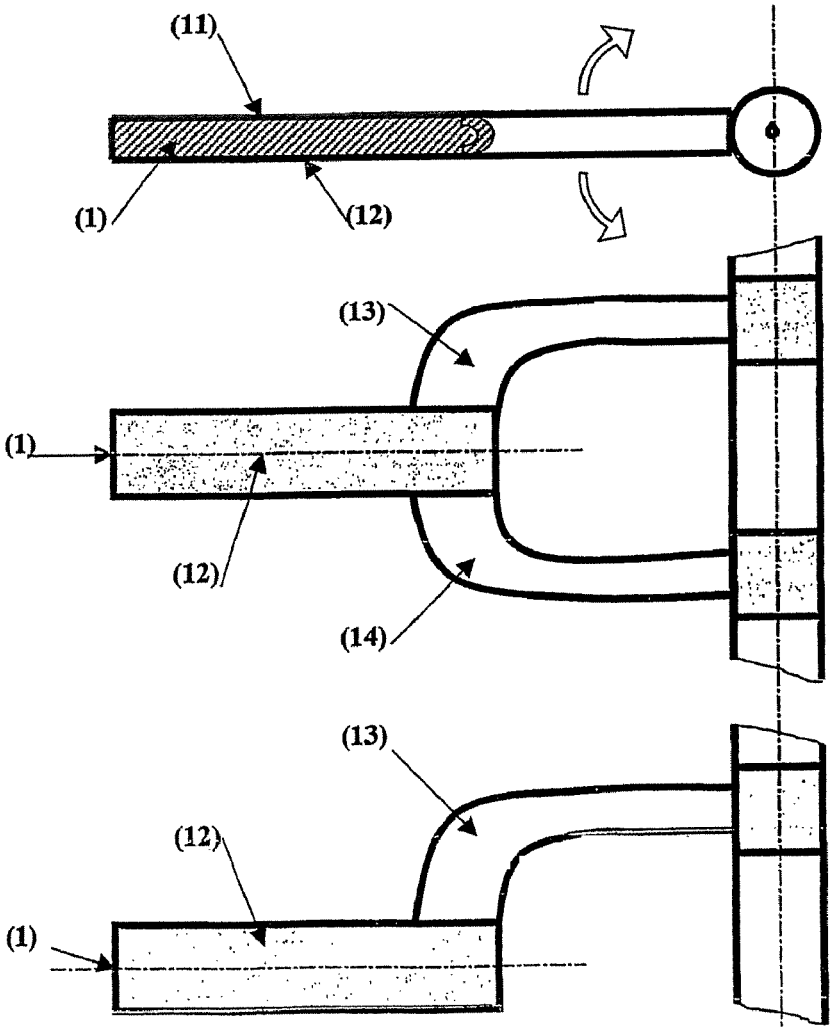
Figure 28:
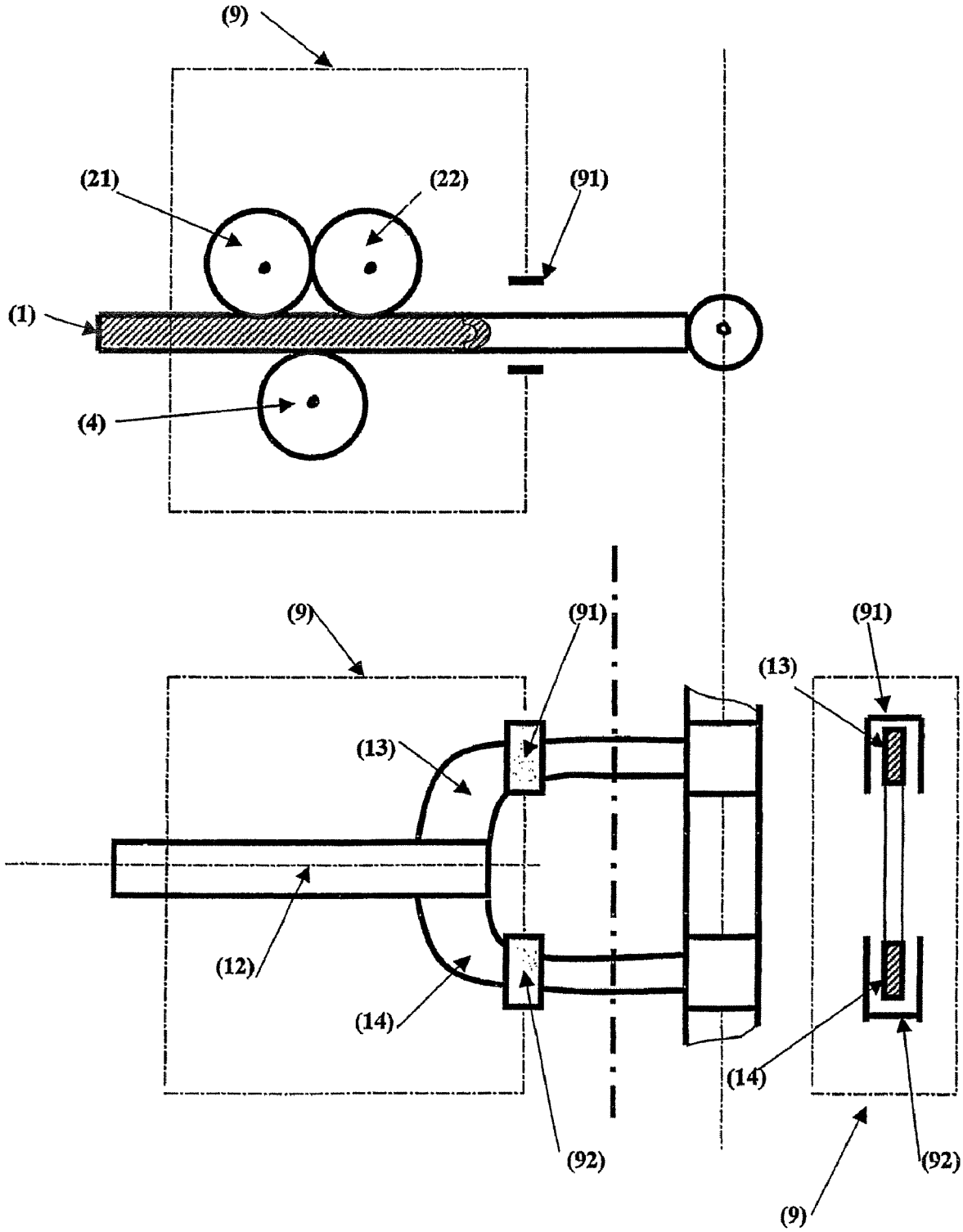

FIG. 26: variation of guiding arm (1) providing a defined zone of reduced contact FIG. 27: variation of guiding arm (1) providing a defined zone without any contact FIG. 28: schematic drawing showing sliding blocks (91) and (92)

Figure 29:
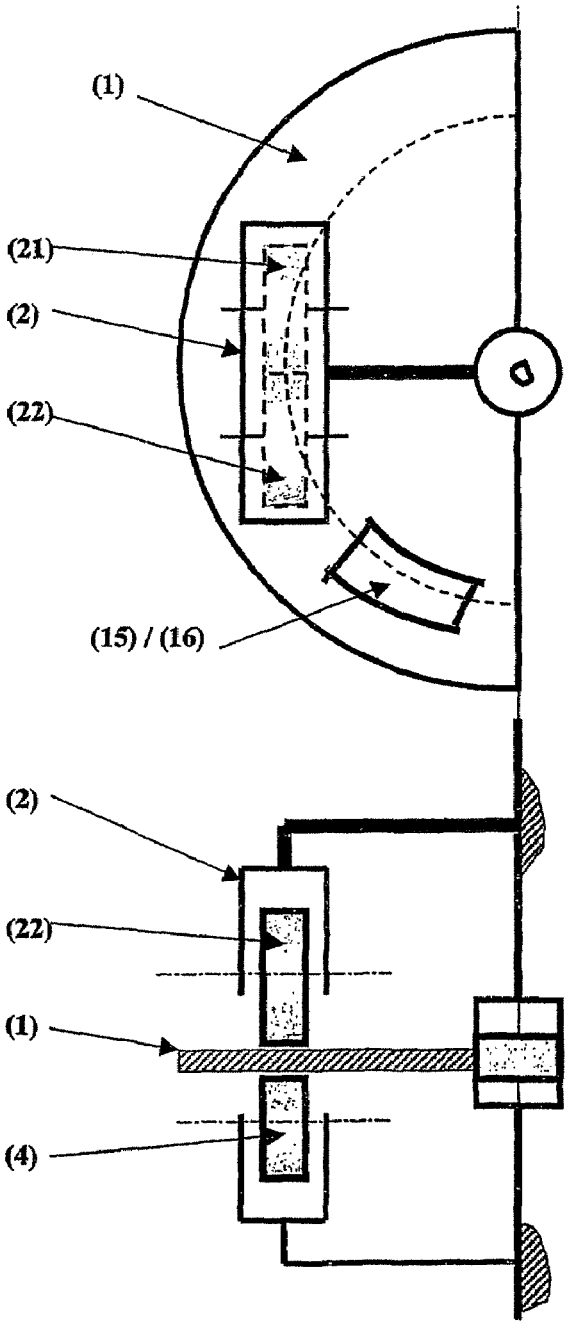

FIG. 29: variation of guiding arm (1)

Figure 30:
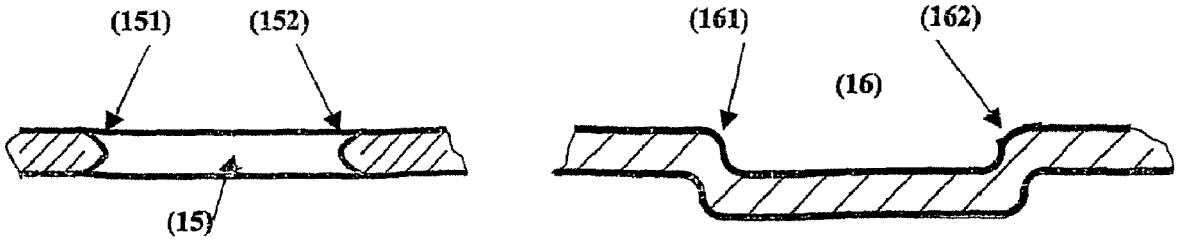

FIG. 30: detail from variation of guiding arm (1) as presented on FIG. 29

Figure 31:
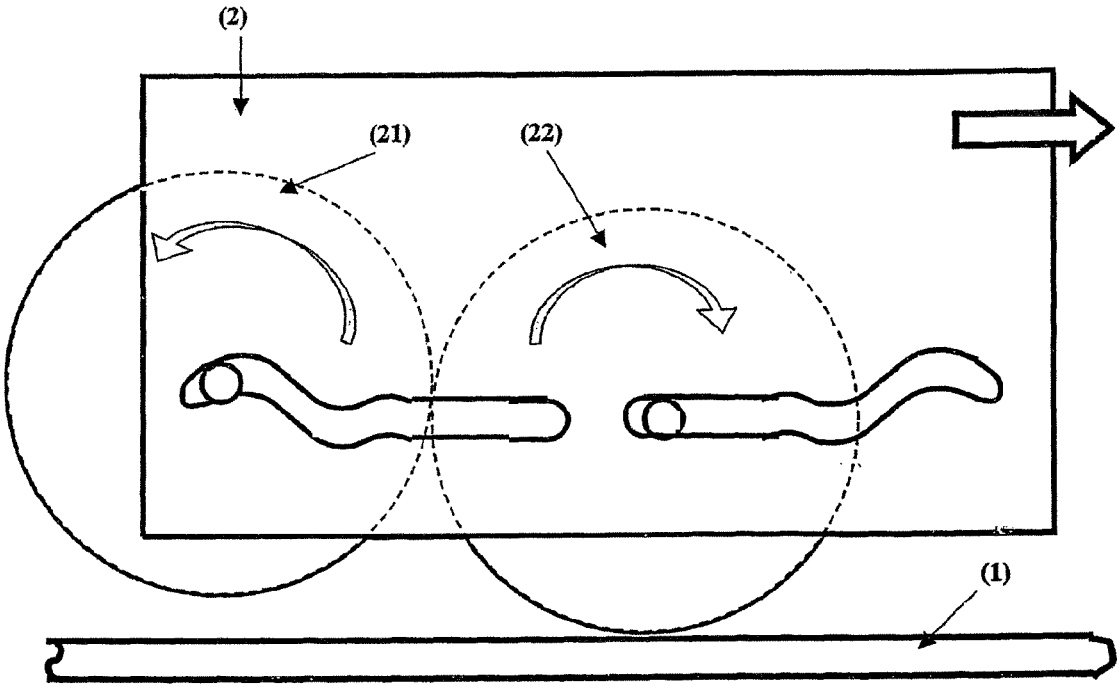

FIG. 31: illustration of operating principle of the mechanism in unlocked position, in the case where rollers (21) and (22) are held permanently in contact with each other by tie device (5)

Figure 32:
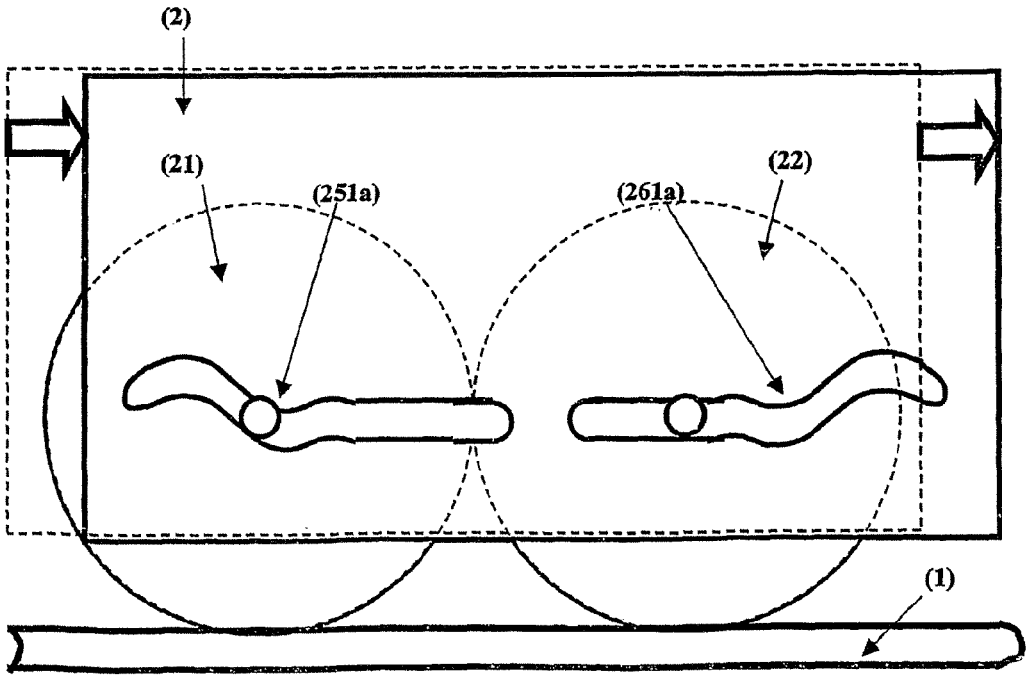

FIG. 32: illustration of carriage device (2) deflection before unlocking, in the case where rollers (21) and (22) are held permanently in contact with each other by a tie device (5)

Figure 33:
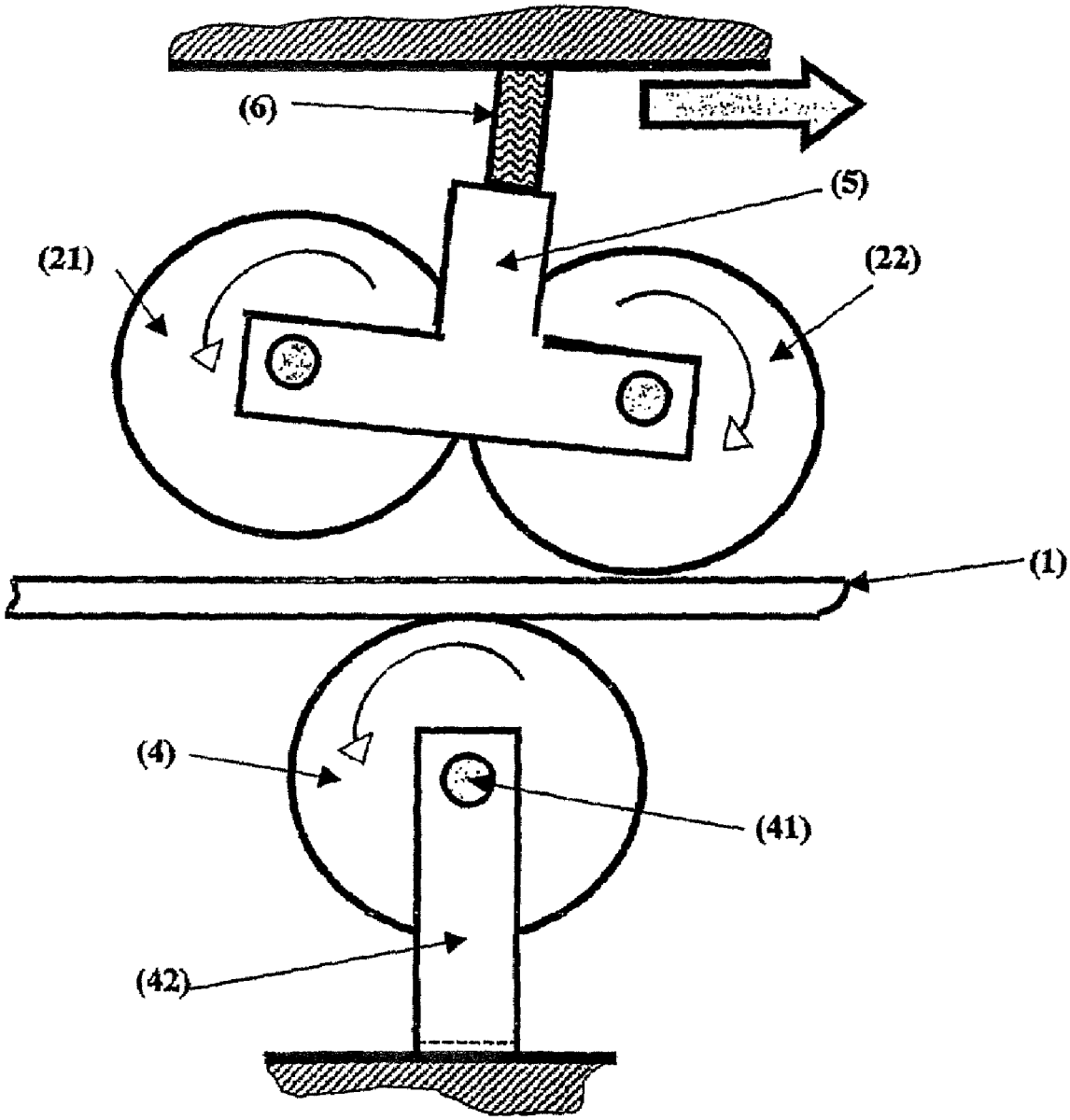

FIG. 33: illustration of mechanism operating principle during unlocked state, according to variation presented on FIG. 6

Figure 34:
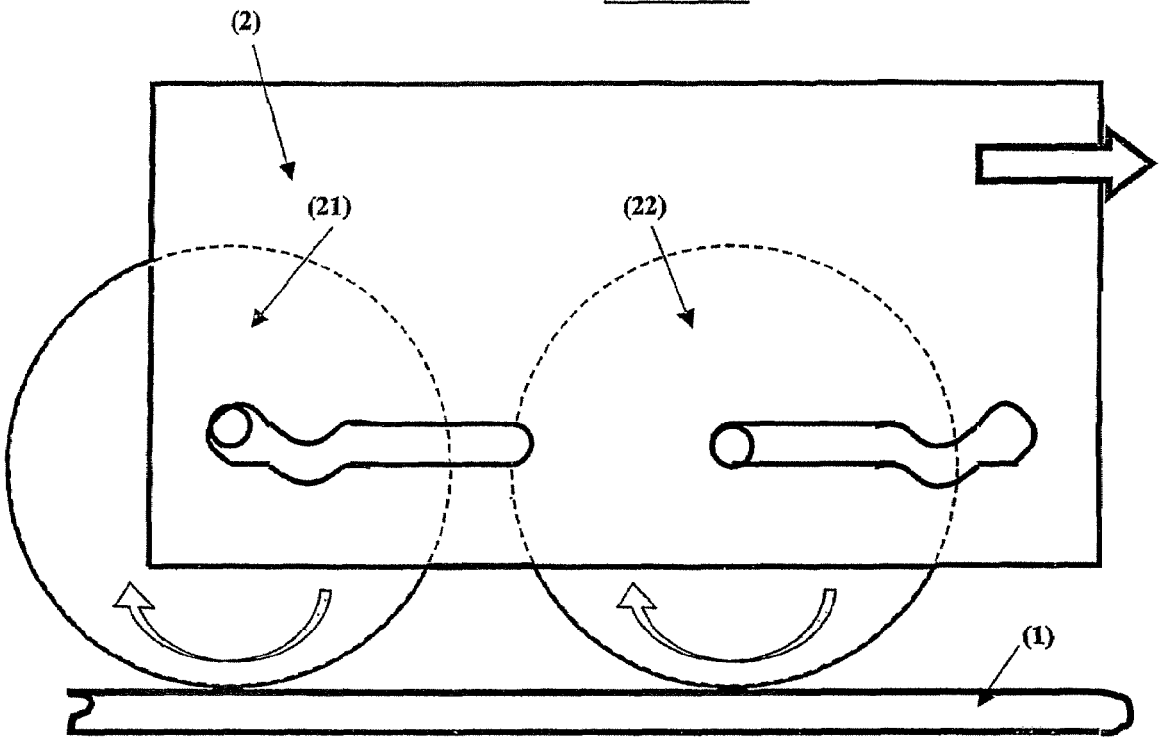
Figure 35:
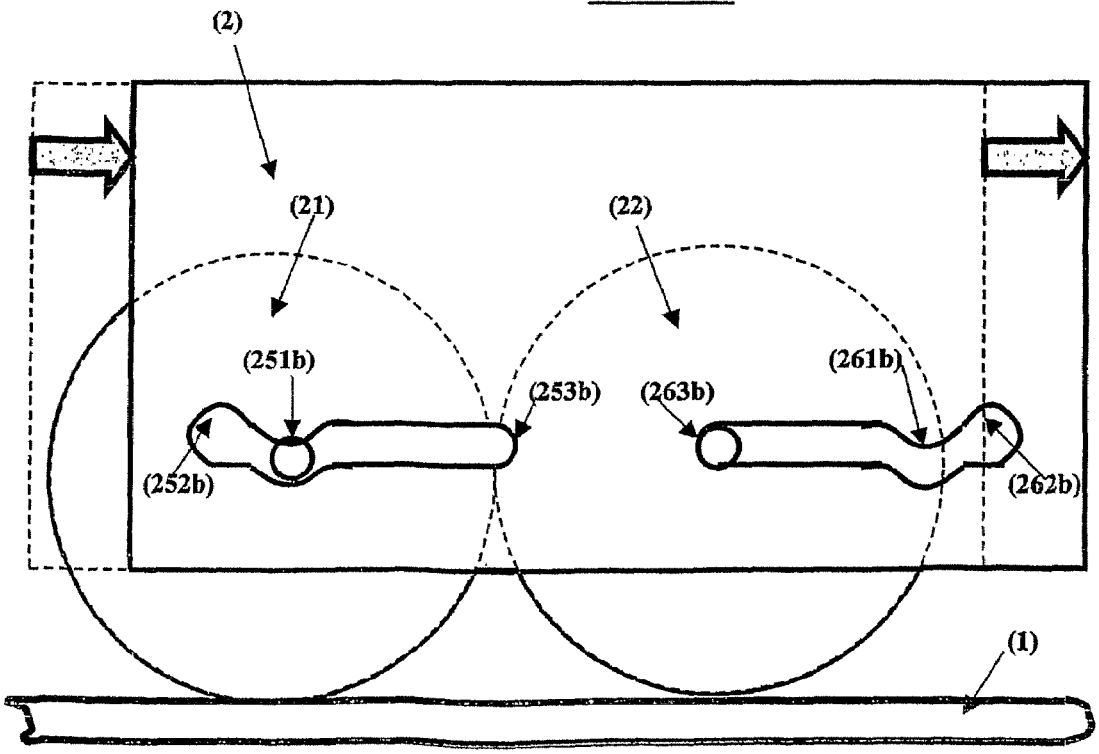

FIG. 34: illustration of mechanism operating principle during unlocked state, in the case where rollers (21) and (22) are not held permanently in contact with each other FIG. 35: illustration of carriage device (2) deflection before unlocking, in the case where rollers (21) and (22) are not held permanently in contact with each other The mechanism comprises: (FIG. 1)

- An articulated guiding arm (1), formed by a metallic rod (or any other resistant material), providing tracks on two opposite faces. This arm will be linked pivotably to one of the vehicle body and passenger door.
- A mechanism (9), linked to one of the door and vehicle body, through which the guiding arm (1) will penetrate and whose purpose is to lock guiding arm (1) in any unpredefined stable position, as long as an operating load does not appear on the door which exceeds the unlock force.

Mechanism (9) comprises:

- A carriage device (2) comprising 2 rollers (21) and (22) acting as a brake system, the said rollers being partly made of material having elastic properties (elastomer or rubber utilized in tires for example). Rollers (21) and (22) are mounted on axles (23) and (24), the said axles being intended to hold and guide rollers (21) and (22) during their displacement relatively to the body of carriage device (2). This link between the carriage device and the rollers is defined in such a way that a displacement between those elements occurs, whenever an operating load appears between guiding arm (1) and carriage device (2). This link can be realized simply by oblong slots (25), (26), (27), (28), provided in the body of carriage device (2), slots inside which axles (23) and (24) can be guided and allowed a limited displacement. (FIG. 2). In locked position, axles (23) and (24) will be separated by a distance slightly less than the rollers diameter, in such a way that the rollers will be compressed against each other. Rollers (21) and (22) being at the same time in contact with guiding arm (1), the system formed by guiding arm (1)/rollers (21) and (22) remains blocked. Carriage device (2) may be directly realized from folded metal sheets, as part of the passenger door or vehicle body, in order to simplify the assembly. Spring device (3) as well as roller (4) and its axle (41), described hereafter, will in this case be directly linked to the door or vehicle body.

A spring device (3), linked to carriage device (2), is made either of a metallic or plastic material element—for example a set of elastic blades, (FIG. 16), or is made of a system built with torsional springs, (FIG. 17)—the said spring device being intended to hold and bring back the axles (23) and (24) in the locked position. The spring device (3) will either act directly on the axles (23) and (24), or act on a tie device (5) which is intended to hold together axles (23) and (24), as described hereafter. (FIG. 18). In any case, spring device (3) can, for example, be composed of helicoidal spring elements, (FIG. 21), or be composed of a deformable elastomer block (FIG. 22). These examples are non limitative.

A roller (4), mounted for free rotation on an axle (41) and assembled to a bracket (42), itself being linked to mechanism (9); the said roller is intended to counterbalance the force seen by guiding arm (1) from carriage device (2) (FIG. 1). For simplification or cost effectiveness, bracket (42) can be directly assembled to the door or to the vehicle body.

A simplified variation will consist into grouping bracket (42) and carriage device (2) to form a single part, itself linked to the door or to the vehicle body, as shown on FIG. 23. Bracket (42) is then no longer needed.

Guiding Arm (1)

Guiding arm (1), (FIG. 24), will be linked to the vehicle body, or to the passenger door, by the means of an articulation allowing sufficient freedom of movement to follow the door's displacement relative to the vehicle body during opening and closing maneuvers. The articulation will not be described herein and can be of any kind from the known art. Guiding arm (1) may be curved to cope with the cinematic constraints resulting from the displacement of the door during opening and closing maneuvers. Guiding arm (1) may be formed in a way to offer several notches if preferred positions are requested. Guiding arm (1) may be formed as to offer two tracks, (11) and (12), located on opposite faces, one of which will constitute a blocking area (11), and will therefore be designed to provide a braking adherence between guiding arm (1) and rollers (21) and (22). In this regard, the adherence between guiding arm and roller may result of surface roughness on track (11), or by any kind of notching, or gearing, matching the exterior shape of rollers (21) and (22). Track (12), located on the opposite face, will act as a guide for roller (4). Cross section of guiding arm (1) may be designed with any shape, (circular, elliptic, . . . ), knowing that a rectangular cross section appears to be among the simplest and cost effective and will therefore be used in all schematic drawings. Nevertheless, this cross section may be designed in order to improve the drive of rollers (21) and (22), as well as guiding and blocking performance, as illustrated in examples shown on FIG. 25, (U, V or reverse V shapes, railroad shape, . . . ). Accordingly, cross sections of rollers (21) and (22) will, in each case, match the cross section of the guiding arm. In addition, cross section of guiding arm (1) may vary, depending on adherence or rolling characteristics requested, these parameters being essential to tune the functionalities required in the technical specifications: load needed on the door during opening or closing maneuvers, with an option to predefine positions with reduced resistance. Specifically, in a position near the full closing of the door, the cross section of the guiding arm may be narrowed, (FIG. 26), and the surface of track (11) may allow rollers (21) and (22) to slide, in order to inhibit any locking in this area. In this regard, some parts of track (11) may be covered with a low friction material (Teflon, surface treatment, . . . ).

Guiding arm (1) may also be realized as indicated on FIG. 27, with two branches (13) and (14), or only one branch (13), in such a way that rollers (21) and (22) encounter a portion of the guiding arm where they have no possible contact with track (11). This arrangement will essentially be used in the positions corresponding to the beginning of opening—or end of closing of the door. Mechanism (9) will in this case be fitted with sliding blocks (91) and (92), shown schematically on FIG. 28, intended to guide branches (13) and (14) and ensuring a smooth connection between rollers (21) and (22), and guiding arm (1) during door maneuvers. Sliding blocks (91) and (92) will not be detailed herein, but will be shaped in a way that they mostly match the cross sections of branches (13) and (14), and in order to allow low friction. A variation may consist of having sliding blocks (91) and (92) directly mounted on the door frame or vehicle body.

Finally, the guiding arm (1) may be curved at its free end, as illustrated on FIG. 24, in order to provide a stop for roller (4)—or for rollers (21) and (22)—providing, in such a way, a limiting device for the fully open position of the door.

Variation: guiding arm (1) my be realized with a rigid plate linked to the vehicle body—or to the door, on which the rollers (21) and (22) will be in contact. (FIG. 29). Roller (4) may be kept to counterbalance the force generated by rollers (21) and (22). However, if guiding plate (1) is sufficiently rigid, roller (4) will become useless. During the door maneuvers, in opening or closing, rollers (21) and (22) will move along an approximate circular path, centered on the axis of the door hinges. Some slots (15) or bosses (16), may be provided on the path of rollers (21) and (22), in order to suppress the locking function in some given positions. (FIG. 30). The shapes given to the connecting areas (151)-(152) or (161)-(162), will be designed in order to provide a smooth ride of rollers (21) and (22) along their path.

Carriage Device (2)

The shape of carriage device (2) will be shown as a schematic drawing and may be optimized to fulfill the requirements of each specific application, essentially to match the geometric constraints imposed by its environnment. (FIG. 2).

Carriage device (2) may be realized from metal, plastic or synthetic material, and will be used as a rigid frame to link the parts that are connected to it. The said carriage may be obtained by cast, molding, forging, stamping, or any other conventional process. Carriage device (2) is linked to the door or to the vehicle body by any conventional means. (Screwing, bolting, crimping, soldering, . . . ).

Carriage device (2) comprises (FIG. 1):

A/Two Braking Rollers (21) and (22)

Braking rollers (21) and (22), respectively mounted on their axles (23) and (24), are designed with approximately cylindrical shape, made of a material allowing an elastic deformation (elastomere, rubber or material utilized to produce tires, . . . ). Rollers (21) and (22), when both in contact with guiding arm (1), are intended to provide a blocking force between guiding arm (1) and mechanism (9). Rollers (21) and (22) will normally have identical diameters; nevertheless, those diameters may slightly differ, in the case an asymmetric load is requested in the opening and closing maneuvers. Rollers (21) and (22) will be made of a more or less soft material, in order to allow an elastic deformation providing a slight rolling resistance during the opening or closing of the door. The material utilized for the rolling surfaces (211) and (221) of rollers (21) and (22), if different from the material utilized for the body of the rollers, will be chosen to allow enough friction along the guiding arm (1) as well as a durability level in conformance with technical specifications requested. The rolling surfaces (211) and (221) of rollers (21) and (22) may be bald, or carved in a way to ensure the best adherence to the rolling path (11). The rolling surfaces (211) and (221) may include notches of any type, corresponding to assorted notches on the rolling path (11) of guiding arm (1). In addition, the cross section of rolling surfaces (211) and (221) will be shaped in accordance with the cross section of rolling path (11), (FIG. 25), in order to optimize the guiding of rollers (21) or (22) along the guiding arm (1).

Rollers (21) and (22) may be assembled in a way to allow free rotation around their axles, or on the contrary in a way that the rollers are fixed to their axles. The choice between either solution will be driven by cost and/or durability considerations. Axles (23) and (24) may be axially secured on carriage device (2), by any conventionnal means: washer and circlip or stop bolt on both sides of carriage lateral slots, boss on the axle, not illustrated in the enclosed figures. In the case where axles (23) and (24) are fixed to rollers (21) and (22), the said rollers being <<trapped>> inside carriage device (2), there might be no need for any axial link. In this case, it might be useful to have lateral pads (212)-(213) and (222)-(223) on both sides of rollers (21) and (22), in order to reduce friction forces between the rollers and the lateral faces of carriage device (2). (FIG. 3).

B/Lateral Guiding Slots (25), (26), (27) and (28): (FIG. 2)

Lateral guiding slots (25), (26), (27) and (28), enclosed on the body of carriage device (2), are intended to hold and guide axles (23) and (24) of rollers (21) and (22), specifically during door opening or closing maneuvers. These lateral guiding slots will be shaped in such a way that they include notches and bosses, intended to produce effects described hereafter. (FIGS. 4 and 11). According to the invention, axles (23) and (24) move inside lateral guiding slots (25), (26), (27) and (28). For this purpose, sliding blocks, respectively (233)-(234) and (243)-(244), may be mounted on to the ends of axles (23) and (24), in order to improve the guiding and the durability of the parts. (FIG. 15). These sliding blocks may be made of a low friction material in accordance with the material which the body of carriage device (2) is made of. Lateral guiding slots (25), (26), (27) and (28), may be obtained by any conventional process from the present art (For example, by stamping in the case of a metallic part or by injection molding in the case of a plastic part). In addition, the areas being in contact with axles (23) and (24) or with sliding blocks (233)-(234) and (243)-(244), may have surface treatment to prevent premature wear. For this purpose, the lateral guiding slots (25), (26), (27) and (28), may be covered with some material providing low friction and improved durability for the mechanism.

The unlocking is obtained by releasing the 3 following parts: guiding arm (1) and rollers (21)/(22). Two different configurations are possible to obtain the unlocking:

a) Rollers (21) and (22) are held permanently in contact with each other by the means of a tie device (5) described hereafter (FIG. 18), while one of the two rollers is moved aside from guiding arm (1), allowing the other roller to rotate along the guiding arm, leading to a relative displacement between carriage device (2) and guiding arm (1). (FIG. 31)

b) Rollers (21) and (22) are not held permanently in contact with each other, although they are permanently kept in contact with guiding arm (1); they are slightly moved aside from each other, in order to allow a free rotation along the guiding arm, leading also to a relative displacement between carriage device (2) and guiding arm (1). (FIG. 34)

In case a), axles (23) and (24) are held at a constant distance by the means of a tie device (5). The axles will be separated by a distance slightly smaller than the addition of the radius of rollers (21) and (22), in order to hold the said rollers permanently in compression against each other, inhibiting their rotation while they are both in contact with guiding arm (1). This configuration leads to block any displacement between carriage device (2) and guiding arm (1). When a force is applied between guiding arm (1) and carriage device (2), (Door opening or closing), axles (23) and (24) start sliding along lateral guiding slots, respectively (25*a*)-(27*a*) and (26*a*)-(28*a*), in an opposite direction to the force applied. (FIG. 4). The shape of lateral guiding slots (25*a*)-(27*a*) and (26*a*)-(28*a*), will comprise bosses (251*a*)-(271*a*) and (261*a*)-(281*a*), intended to resist to the displacement of axles (23) and (24), during opening and closing maneuvers, allowing to calibrate the force needed to unlock the mechanism as well as to define the clearance between locked and unlocked positions as requested for the door. (FIG. 32). One will notice that the elasticity of the rollers' constituent material has an impact on the calibration of the unlocking force, rollers (21) and (22) being slightly <<crushed>> against guiding arm (1), when axles (23) and (24) pass over bosses, respectively (251*a*)-(271*a*), or (261*a*)-(281*a*). The lateral guiding slots (25*a*), (26*a*), (27*a*) and (28*a*), will also include bosses (252*a*)-(272*a*) and (262*a*)-(282*a*) (FIG. 4), designed to generate, during opening or closing maneuvers, a slight displacement of one of the axles (23) or (24), in a perpendicular direction to the guiding arm (1), which leads to a slight lifting up of one of the rollers (21) or (22) from the guiding arm, allowing in this way the rotation of the other roller, which itself has remained in contact with guiding arm (1). It may be noticed that the roller that has been lifted from the guiding arm will also rotate, in the opposite direction, but this roller does not block the guiding arm any longer. (FIG. 31). The slopes, respectively (2521*a*)-(2522*a*), (2621*a*)-(2622*a*), (2721*a*)-(2722*a*) and (2821*a*)-(2822*a*) of bosses (252*a*), (262*a*), (272*a*) and (282*a*) will normally be asymmetric. (FIG. 4). Finally, lateral guiding slots (25*a*)-(27*a*) and (26*a*)-(28*a*), comprise notches (253*a*)-(273*a*) and (263*a*)-(283*a*) into which, axles (23) and (24) respectively, slip during opening and closing of the door.

The force produced by the spring device (3) on axles (23) or (24) when positioned inside two of notches (253*a*)-(273*a*) or (263*a*)-(283*a*), is partly counterbalanced by the rolling resistance of roller (21) or (22) along guiding arm (1). As soon as the force driving carriage device (2) along guiding arm (1) disappears, the spring device (3) tends to extract axle (23) or (24) from notches respectively (253*a*)-(273*a*) or (263*a*)-(283*a*), to bring the said axle back into the initial locked position. Rollers (21) and (22) are then again both in contact with guiding arm (1) and ensure a blocking between carriage device (2) and guiding arm (1). This re-locking operation, will take place within a limited clearance, from the point where the opening or closing load was interrupted. This clearance may be defined by the size of lateral guiding slots (25*a*), (26*a*), (27*a*) and (28*a*). It is then easy to obtain any stable position for the door, chosen during an opening or closing maneuver. The wedging of the door appears automatically as soons as the force needed to open or close the door is interrupted, with no need to look for a predefined locking position.

A slight variation may be proposed concerning lateral guiding slots (25*a*), (26*a*), (27*a*) and (28*a*): in fact, as axles (23) and (24) from rollers (21) and (22) are held by a tie device (5), it is possible to locate guiding slots (25*a*), (26*a*), (27*a*) and (28*a*) at a different place from the ends of axles (23) and (24), and therefore to provide tie device (5) with sliding blocks moving inside the said guiding slots to ensure the same functions as the ones described hereabove. (FIG. 5).

In addition, a simplified variation can be proposed: tie device (5) may be directly linked to the door (or to the vehicle body) if its constituent material has elastic properties, otherwise said tie device may be linked through an elastic device (Flexible bracket (6) shown on schematic drawing in FIG. 6 or block made of elastic material (7) shown on schematic drawing in FIG. 7). In both cases, when a load is applied to the door, the mechanism formed by rollers (21)-(22) and the tie device (5) starts rocking, (FIG. 33), which leads to having one of the rollers (21) or (22) moved aside from guiding arm (1), whether the maneuver is in the opening or closing direction, and hence allowing a displacement between the mechanism formed by rollers (21)-(22) linked by tie device (5), and guiding arm (1). When the opening or closing load disappears, the flexible bracket (6) or the elastic block (7) automatically bring the rollers (21)-(22) back into contact with guiding arm (1), providing in this way a blocking between rollers (21)-(22) and guiding arm (1). Flexible bracket (6), or elastic block (7), will be directly linked to the door or to the vehicle body by any conventional means not detailed here (Screwing, bolting, welding, crimping, . . . ). Flexible bracket (6) will be made of a material having elastic properties. (Metal, plastic, synthetic material, . . . ). The shape of flexible bracket (6) will be designed in a way that the flexion takes place in a direction mainly parallel to guiding arm (1), in order to allow the needed clearance of rollers (21) and (22) between locked and unlocked positions. The result achieved in this way may be less performant, because it is necessary to provide a constant opening or closing load during the maneuver, equivalent to the unlocking force. Nevertheless, in this case the carriage device (2) is not needed, which is a cost saving.

In case b), axles (23) and (24) are only held by the lateral guiding slots (25*b*), (26*b*), (27*b*) and (28*b*), from carriage device (2), and are submitted to the forces provided by elastic device (3), which tend to push the said axles towards each other. (FIG. 1). Axles (23) and (24) may however be moved aside from each other, in a way that rollers (21) and (22) are no longer in contact with each other, so that they may rotate (in the same direction) along guiding arm (1); this configuration allows a displacement between carriage device (2) and guiding arm (1). (FIG. 34). Lateral guiding slots (25*b*), (26*b*), (27*b*) and (28*b*), will comprise bosses (251*b*), (261*b*), (271*b*) and (281*b*), (FIG. 11), intended to resist to the displacement of axles (23) and (24), allowing to calibrate the force needed to unlock the mechanism as well as to define the clearance between locked and unlocked positions as requested for the door. (FIG. 35). One will notice that the elasticity of the rollers' constituent material has an impact on the calibration of the unlocking force, rollers (21) and (22) being slightly <<crushed>> against guiding arm (1), when axles (23) and (24) pass over bosses, respectively (251*b*)-(271*b*), or (261*b*)-(281*b*). The lateral guiding slots (25*b*), (26*b*), (27*b*) and (28*b*), will comprise notches (252*b*), (262*b*), (272*b*) and (282*b*), (FIG. 11), into which, axles (23) or (24) will slip during opening and closing of the door. The slopes, respectively (2511*b*)-(2512*b*), (2611*b*)-(2612*b*), (2711*b*)-(2712*b*) and (2811*b*)-(2812*b*) of bosses (251*b*), (261*b*), (271*b*) and (281*b*), may be slightly asymmetrical, in order to differentiate the forces needed to lock or unlock. Lateral guiding slots (25*b*), (26*b*), (27*b*) and (28*b*) enclose extremities (253*b*), (263*b*), (273*b*) and (283*b*), (FIG. 11), limiting the displacement of one of the axles (23) or (24), according to whether the door is being opened or closed, allowing in this way to separate rollers (21) and (22). The position of extremities (253*b*), (263*b*), (273*b*) and (283*b*) with regard to bosses (251*b*), (261*b*), (271*b*) and (281*b*), will be designed in a way that when one of the two axles (23) or (24) is stopped by some of the extremities (253*b*)-(273*b*) or (263*b*)-(283*b*), the other axle, respectively (24) or (23), is located at the top of bosses respectively (261*b*)-(281*b*) or (251*b*)-(271*b*), allowing the said axle to naturally slip inside notches respectively (262*b*)-(282*b*), or (252*b*)-(272*b*). (FIGS. 11 and 35). The force applied by the elastic device (3) on axle (23) or (24) while in notches (252*b*)-(272*b*) or (262*b*)-(282*b*), is partly counterbalanced by the rolling resistance of roller (21) or (22) on guiding arm (1). When the driving force between carriage device (2) and guiding arm (1) disappears, the elastic device (3) tends to bring back axles (23) and (24) in their initial <<locked>> positions. Rollers (21) and (22) are then again in contact and in compression against each other, thanks to the elastic device (3). This re-locking operation, will take place within a limited clearance, from the point where the opening or closing load was interrupted. This clearance may be defined by the size of lateral guiding slots (25*b*), (26*b*), (27*b*) and (28*b*). It is then easy to obtain any stable position for the door, chosen during an opening or closing maneuver. In addition, the wedging of the door appears automatically as soons as the force needed to open or close the door is interrupted, with no need to look for a predifined locking position.

Variation: in order to reinforce the stability of rollers (21) or (22) in <<unlocked>> positions, it may be considered to place permanent magnets (or any other material with magnetic properties), (254), (264), (274), (284), just beside notches respectively (253*a*), (263*a*), (273*a*), (283*a*), or (252*b*), (262*b*), (272*b*), (282*b*). (FIGS. 8 and 12). The way the magnets are mounted is not described herein, but may be realized by any conventional means (Crimping, gluing, screwing, or other). In this case, axles (23) and (24) of rollers (21) and (22) will necessarily be made of some material having magnetic properties: metal, magnetic material. An other option, may be to add parts (231), (232), (241), and (242), with magnetic properties, to the ends of axles (23) and (24), as shown in FIGS. 9 and 13, in a way that parts (231), (232), (241), and (242), move to face permanent magnets (254), (274), (264) and (284) respectively.

A variation may be to realize parts (231), (232), (241), and (242) in some material having magnetic properties and to place some blocks (255), (265), (275) and (285), beside notches respectively (253*a*), (263*a*), (273*a*) and (283*a*), or (252*b*), (262*b*), (272*b*) and (282*b*). (FIGS. 10 and 14). The blocks (255), (265), (275) and (285), may be realized with the same material as the body of carriage device (2), provided the said body is made of some material having magnetic properties. The blocks (255), (265), (275) and (285), may be, for example, realized by simply cutting and bending a part of lateral faces of carriage device (2).

Spring Device (3)

A spring device (3), linked to carriage device (2), is intended to hold or bring back axles (23) and (24) in their normal <<rest>> position, with rollers (21) and (22) blocked against each other in contact with guiding arm (1). This spring device (3) may be realized with flexible metallic or plastic blades, acting directly on axles (23) and (24), as shown on schematic drawing in FIGS. 16 and 17. The spring device (3) may also act indirectly on a tie device (5), (FIG. 18), the said tie device being intended to hold axles (23) and (24). Spring device (3) may, for example but not exhaustively, be realized with one or several coil springs, or laminated springs, or realized with an elastic block as elastomer. (FIGS. 21 and 22). In the case where axles (23) and (24) are held by a tie device (5), the said tie device may be directly linked to the door (or to the body of the vehicle), or by the means of an elastic part (Flexible bracket (6) shown on schematic drawing in FIG. 6, or block made of an elastic material (7) shown on schematic drawing in FIG. 7, as described hereabove in a simplified variation). In this case, spring device (3) is replaced by flexible bracket (6) or by elastic block (7).

Roller (4)

Roller (4) will be intended to counterbalance the load seen on guiding arm (1) from carriage device (2), allowing guiding arm (1) to be held during its displacement through mechanism (9). (FIG. 1). Roller (4) will rotate freely on its axle (41). Axle (41) will be mounted on bracket (42), itself linked to carriage device (2), or axle (41) can otherwise be directly linked to a part of the door (or of the vehicle body). Axle (41) will be axially secured on bracket (42) in any conventional way: circlip, pin, boss on the axle, not illustrated on the enclosed figures.

Tie Device (5)

Tie device (5) (FIG. 18), is intended to hold the axles (23) and (24) of rollers (21) and (22) at a constant distance, without interfering with the mobility of the said axles along lateral guiding slots (25), (26), (27) and (28). The shape of tie device (5) will only be shown on a schematic drawing and may be optimized for each specific application, essentially to match dimensional constraints. The said tie device may be formed by a single part (FIG. 18), realized with plastic material, metal, synthetic material, and produced by any conventional means. (molding, cast, forging, stamping or other conventional process). Tie device (5) will provide two lateral faces (51) and (52), with apertures (511)-(512) and (521)-(522) intended to hold axles (23) and (24). A simplified variation of tie device (5) is shown on a schematic drawing in FIG. 19, and consists of two lateral faces (51) and (52), that are not linked to each other, and that provide apertures (511)-(512) and (521)-(522) to hold axles (23) and (24).

Axles (23) and (24) will be axially secured on tie device (5) by any conventional means: circlip, pin, boss on the axle, not illustrated on the enclosed figures. Tie device (5) may also be simply <<trapped>> inside carriage device (2), in a way that it becomes not necessary to axially secure axles (23) and (24). (FIG. 20).

The invention claimed is:

1. A door check mechanism providing an infinite number of stable positions between full opening and closing, the door check mechanism comprising:

a guiding arm linked to a steady part, or linked to a moving part; and a mechanism, linked to an opposite of the steady part or moving part, in such a way that the guiding arm penetrates through the mechanism with a relative displacement between those two steady and moving parts, a wedge function being provided by a relative blocking of the guiding arm through the mechanism;

wherein the guiding arm provides a rolling and relative blocking path between the guiding arm and the mechanism, whereas the surface of the rolling path provides appropriate roughness to ensure adherence of rollers, the rollers being configured to wedge the guiding arm, which may therefore enclose notches that will match the exterior shape of the rollers, the rollers being made of a material having elastic properties;

wherein the mechanism includes a carriage device, which comprises 2 juxtaposed braking of the rollers, both in contact with the guiding arm and respectively mounted on their axles, the axles can move along lateral guiding slots, which are provided on the sides of carriage device, whereas a spring device, acting on the axles, is configured to hold and bring back the rollers to the locked position, in which the rollers are both in contact with the guiding arm and held in compression against each other, which leads to block the rollers on the guiding arm, while the force exerted on the guiding arm by the rollers is counterbalanced by another roller, mounted opposite of the rollers, which leads to hold the guiding arm during its relative displacement through the mechanism, the mechanism ensuring three functions hereafter:

a) blocking of the rotation of the rollers against the guiding arm, in any un-predefined position, b) release of the rotation of the rollers, whenever an opening or closing force greater than a predefined release threshold is exerted on the door, this release taking place within a limited clearance between the mechanism and the guiding arm, c) automatic re-locking, in any un-predefined position of the door, when the opening or closing force disappears;

further comprising lateral guiding slots, comprising bosses and notches, configured to resist displacement of the axles, and configured to provide stable positions, during respectively locked phase and opening or closing maneuvers, the bosses and notches being configured such that the displacements of the axles, lead to put the rollers in one of the 2 configurations hereafter, allowing the un-locking:

a) the rollers are held permanently in contact with each other, by a tie device, the un-locking being reached as soon as one of the two rollers is set aside from the guiding arm, allowing a rotation of the other roller along the guiding arm, therefore leading to a relative displacement between the carriage device and the guiding arm;

b) the rollers are not linked to each other, but are kept permanently in contact with the guiding arm as a result from the shape and location of the lateral guiding slots, the un-locking appearing as soon as the two rollers are moved aside from each other, in a way that they may freely roll along the guiding arm, allowing a relative displacement between the carriage device and the guiding arm;

and further comprising a spring device that exerts a compression force on the axles, tending to bring the axles back towards each other in the central locked position, and whereas the spring device tends to resist lateral displacement of the axles along the lateral guiding slots, in a way that when the opening or closing maneuver is stopped, the axles spontaneously reach their stable rest positions, the rollers being blocked against each other in contact with the guiding arm, clearance of the door during this re-locking phase being limited by the size of the lateral guiding slots;

wherein the tie device is configured to hold the rollers, and the spring device may act directly on the tie device.

2. The door check mechanism as described in claim 1, wherein the tie device is configured to hold the axles, and is directly linked to the door, provided the tie device is realized in a material having elastic properties, allowing a limited bending, or provided the tie device is otherwise linked by an elastic part, a flexible bracket, or an elastic block, allowing to bend the assembly formed by the rollers and the tie device, whenever an opening or closing force is exerted on the door, leading therefore to pull one of the rollers aside from the guiding arm, which results in a relative displacement of the rollers along the guiding arm, whereas if the opening or closing force stops, the flexible bracket or the elastic block automatically bring the rollers back into contact with the guiding arm, to obtain a blocking between the rollers and the guiding arm.

3. The door check mechanism as described in claim 1, wherein a bracket of the another roller is part of the carriage device, to form a single part.

4. The door check mechanism as described in claim 1, wherein parts with magnetic properties are placed near the lateral guiding slots, or are placed on the axles, to improve stability of the axles when positioned in their notches during the opening or closing of the door.

5. The door check mechanism as described in claim 1, wherein the cross section of the peripheral surface of the rollers have U, V, or railroad type shapes to improve the guiding of the rollers, the rolling path from the guiding arm being therefore shaped accordingly.

6. The door check mechanism as described in claim 1, wherein the guiding arm comprises two branches or only one branch, in such a way that the rollers encounter a portion of the guiding arm where they have no possible contact with the rolling path, whereas the branches are guided by sliding blocks.

7. The door check mechanism as described in claim 1, wherein the guiding arm is realized with a rigid plate linked to the steady part or the moving part, with which the rollers will be in contact, and whereas the rollers will move along an approximate circular path centered on the axis of door hinges, during door maneuvers, in opening or closing.

8. The door check mechanism as described in claim 1, wherein the lateral guiding slots are located at a different place from the ends of the axles, the rollers being held by the tie device, the tie device being fitted with sliding blocks moving inside the lateral guiding slots.

* * * * *